US011396879B2

(12) United States Patent
Kashihara et al.

(10) Patent No.: US 11,396,879 B2
(45) Date of Patent: Jul. 26, 2022

(54) CROSS-FLOW BLOWER AND INDOOR UNIT OF AIR-CONDITIONING DEVICE EQUIPPED WITH SAME

(71) Applicant: DAIKIN INDUSTRIES, LTD., Osaka (JP)

(72) Inventors: Takashi Kashihara, Osaka (JP); Jinfan Ryuu, Osaka (JP); Hironobu Teraoka, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 789 days.

(21) Appl. No.: 16/332,550

(22) PCT Filed: Sep. 29, 2017

(86) PCT No.: PCT/JP2017/035668
§ 371 (c)(1),
(2) Date: Mar. 12, 2019

(87) PCT Pub. No.: WO2018/062540
PCT Pub. Date: Apr. 5, 2018

(65) Prior Publication Data

US 2021/0172445 A1 Jun. 10, 2021

(30) Foreign Application Priority Data

Sep. 30, 2016 (JP) ..... JP2016-194397

(51) Int. Cl.
*F04D 17/04* (2006.01)
*F24F 1/0025* (2019.01)
(Continued)

(52) U.S. Cl.
CPC ..... *F04D 17/04* (2013.01); *F04D 29/441* (2013.01); *F04D 29/661* (2013.01); *F24F 1/00* (2013.01);
(Continued)

(58) Field of Classification Search
CPC ..... F02D 17/04; F02D 29/281; F02D 29/283; F02D 29/422; F02D 29/4226; F02D 29/441; F02D 29/661; F02F 1/00; F02F 1/0025
See application file for complete search history.

(56) References Cited

U.S. PATENT DOCUMENTS 2,968,436 A * 1/1961 Coester ..... F04D 17/04 62/426
3,258,195 A * 6/1966 Laing ..... F04D 17/04 415/53.3
(Continued)

FOREIGN PATENT DOCUMENTS

EP 0 277 044 A2 8/1988
GB 830362 A * 3/1960
(Continued)

OTHER PUBLICATIONS

Extended European Search Report dated Mar. 10, 2020, for European Application No. 17856487.8.
(Continued)

*Primary Examiner* — John M Zaleskas
(74) *Attorney, Agent, or Firm* — Birch, Stewart, Kolasch & Birch, LLP

(57) ABSTRACT

Disclosed is a cross-flow fan including a fan rotor and a housing. The cross-flow fan has a blow-out path defined by first and second extension wall portions and two sidewalls. The first extension wall portion continuously extends from a tongue portion of the housing to the blow-out port. The second extension wall portion faces the first extension wall portion. The two sidewalls are respectively provided at axial ends of the fan rotor. The two sidewalls are formed such that the blow-out path has a narrowed portion whose cross-sectional area decreases as its cross-sectional shape changes from a rectangular shape to a trapezoidal shape from an
(Continued)

upstream side toward a downstream side thereof, the trapezoidal shape having a portion near the second extension wall portion smaller in width than a portion near the first extension wall portion.

7 Claims, 9 Drawing Sheets

(51) Int. Cl.
*F24F 1/00* (2019.01)
*F04D 29/66* (2006.01)
*F04D 29/44* (2006.01)
*F04D 29/28* (2006.01)
*F04D 29/42* (2006.01)

(52) U.S. Cl.
CPC ..... *F24F 1/0025* (2013.01); *F04D 29/281* (2013.01); *F04D 29/4226* (2013.01)

(56) References Cited

U.S. PATENT DOCUMENTS 3,306,526 A * 2/1967 Laing ..... F04D 17/04 415/53.3
3,446,426 A * 5/1969 Bornstein ..... F04D 17/04 415/208.2
3,459,365 A * 8/1969 Bornstein ..... F04D 17/04 415/119
3,460,647 A * 8/1969 Laing ..... B60V 1/00 415/53.3
3,695,775 A * 10/1972 Zenkner ..... F04D 17/04 415/212.1
4,913,622 A * 4/1990 Tanaka ..... F04D 17/04 415/53.3
4,958,504 A * 9/1990 Ichikawa ..... B60H 1/247 165/122
5,056,987 A * 10/1991 Tanaka ..... F04D 17/04 415/53.3
5,197,850 A * 3/1993 Shinobu ..... F04D 17/04 415/53.3
6,141,983 A * 11/2000 Nishikawa ..... F24F 1/0047 415/53.3
2013/0101405 A1* 4/2013 Shiraichi ..... F04D 29/30 415/191
2013/0259669 A1* 10/2013 Tadokoro ..... F04D 29/30 415/185
2014/0134939 A1* 5/2014 Kamada ..... F24F 13/15 454/309
2014/0301825 A1* 10/2014 Tian ..... F04D 17/04 415/53.1
2015/0275899 A1* 10/2015 Chen ..... F28D 1/024 415/53.1
2017/0267342 A1* 9/2017 Lord ..... B64C 39/005
2017/0276379 A1* 9/2017 Ikeda ..... F24F 13/30
2019/0331351 A1* 10/2019 Ryuu ..... F24F 1/0047
2021/0033288 A1* 2/2021 Teraoka ..... F24F 1/0025
2021/0048220 A1* 2/2021 Teraoka ..... F04D 25/14

FOREIGN PATENT DOCUMENTS

GB 1 066 053 A 4/1967
GB 1 131 689 A 10/1968
GB 1131689 A * 10/1968
JP 57134644 A * 8/1982
JP 59034497 A * 2/1984
JP 2008-275231 A 11/2008

OTHER PUBLICATIONS

International Search Report for PCT/JP2017/035668 (PCT/ISA/210) dated Nov. 28, 2017.

* cited by examiner

CROSS-FLOW BLOWER AND INDOOR UNIT OF AIR-CONDITIONING DEVICE EQUIPPED WITH SAME

TECHNICAL FIELD

The present invention relates to a cross-flow fan and an indoor unit of an air conditioner including the same.

BACKGROUND ART

A cross-flow fan has been used in an indoor unit of an air conditioner (see, e.g., Patent Document 1 indicated below).

The cross-flow fan includes a cylindrical fan rotor which has a plurality of blades and rotates about a center axis, and a housing having a suction port for sucking the air and a blow-out port for blowing the air out, and housing the fan rotor therein. In this cross-flow fan, the fan rotor rotates about the center axis in the housing, thereby allowing the air sucked into the housing through the suction port to flow through the fan rotor toward the blow-out port.

CITATION LIST

Patent Documents

[Patent Document 1] Japanese Unexamined Patent Publication No. 2008-275231

SUMMARY OF THE INVENTION

Technical Problem

In a blow-out path defined between a tongue portion and blow-out port of the housing of the cross-flow fan, blown air easily flows toward a wall portion (hereinafter referred to as a "first wall portion") which is continuous from the tongue portion to the blow-out port. Thus, the blown air does not flow much toward another wall portion (hereinafter referred to as a "second wall portion") facing the first wall portion, and the flow rate of the blown air along the second wall portion becomes significantly lower than that along the first wall portion. Therefore, during a high-load operation, the blown air may be separated from the second wall portion to generate noise. At both end portions of the blow-out path in contact with sidewalls of the housing, the flow rate of the blown air decreases as the blown air flows downstream due to friction with the side wall portions of the housing. Thus, when the pressure loss of the air flow increases in the indoor unit due to clogging of a filter or any other factors, the blown air may hardly flow at the end portions of the blow-out path near the blow-out port, and the air may reversely flow toward the upstream of the blow-out path from the end portions. In particular, at two corners of the second wall portion near the blow-out port of the blow-out path, no blown air flows, and the air significantly flows in a reverse direction toward the upstream of the blow-out path from the blow-out port. Such a reverse flow occurring in the blow-out path causes surging.

In view of the foregoing background, it is therefore an object of the present invention to provide a cross-flow fan which reduces noise and surging due to backflow, and an indoor unit of an air conditioner including the same.

Solution to the Problem

A first aspect of the present disclosure is directed to a cross-flow fan including: a fan rotor (31) including a plurality of blades (34) and rotating about a center axis (X); and a housing (32) having a suction port (32*a*) for sucking air and a blow-out port (32*b*) for blowing the air out, and housing the fan rotor (31) therein, wherein the housing (32) has a tongue portion (36*a*), a first wall portion (36*b*), a second wall portion (37*b*), and two sidewalls (38), the tongue portion (36*a*) being close to an outer periphery of the fan rotor (31) and extending in an axial direction of the fan rotor (31), the first wall portion (36*b*) continuously extending from the tongue portion (36*a*) to the blow-out port (32*b*), the second wall portion (37*b*) facing the first wall portion (36*b*), the two sidewalls (38) being respectively provided at axial ends of the fan rotor (31) to define a blow-out path (F) between the first wall portion (36*b*) and the second wall portion (37*b*), and the two sidewalls (38) are formed such that the blow-out path (F) has a narrowed portion (70) whose cross-sectional area decreases as its cross-sectional shape changes from a rectangular shape to a trapezoidal shape from an upstream side toward a downstream side thereof, the trapezoidal shape having a portion near the second wall portion (37*b*) smaller in width than a portion near the first wall portion (36*b*).

According to the first aspect of the present disclosure, the blow-out path (F) of the cross-flow fan (30) is provided with the narrowed portion (70) whose the cross-sectional area decreases as its cross-sectional shape changes from a rectangular shape to a trapezoidal shape having a portion near the second wall portion (37*b*) smaller in width than a portion near the first wall portion (36*b*). Therefore, when the blown air that has flowed into the blow-out path (F) passes through the narrowed portion (70), the flow is gradually contracted. In particular, the width of a portion of the narrowed portion (70) near the second wall portion (37*b*), where the blown air does not easily flow, gradually decreases as it extends from the upstream side to the downstream side. Thus, when the blown air that has flowed into the blow-out path (F) passes through the narrowed portion (70), the flow of the blown air near the second wall portion (37*b*) is gradually contracted.

However, unlike the configuration described above, when the cross-sectional area of a downstream portion of the blow-out path (F) is not reduced, the flow rate of the blown air decreases due to friction with the two sidewalls (38) at the end portions of the blow-out path (F), and the blown air may hardly flow at the end portions of the blow-out path (F) near the blow-out port (32*b*) of the blow-out path (F).

In the first aspect of the present disclosure, the flow of the blown air is gradually contracted by the narrowed portion (70). This can reduce the decrease in the flow rate of the blown air at the end portions of the blow-out path (F) near the blow-out port (32*b*). In particular, the width of the portion of the narrowed portion (70) near the second wall portion (37*b*), where the blown air does not easily flow, gradually decreases as it extends from the upstream side to the downstream side. This can reduce the decrease in the flow rate of the blown air near the second wall portion (37), where the flow rate of the blown air is significantly lower than that near the first wall portion (36*b*) in the downstream side of the blow-out path (F).

A second aspect of the present disclosure is directed to a cross-flow fan including: a fan rotor (31) including a plurality of blades (34) and rotating about a center axis (X); and a housing (32) having a suction port (32*a*) for sucking air and a blow-out port (32*b*) for blowing the air out, and housing the fan rotor (31) therein, wherein the housing (32) has a tongue portion (36*a*), a first wall portion (36*b*), a second wall portion (37*b*), and two sidewalls (38), the tongue portion (36*a*) being close to an outer periphery of the fan rotor (31) and extending in an axial direction of the fan rotor (31), the first wall portion (36*b*) continuously extending from the tongue portion (36*a*) to the blow-out port (32*b*), the second wall portion (37*b*) facing the first wall portion (36*b*), the two sidewalls (38) being respectively provided at axial ends of the fan rotor (31) to define a blow-out path (F) between the first wall portion (36*b*) and the second wall portion (37*b*), and the blow-out path (F) has a narrowed portion (70) whose cross-sectional area decreases as a distance between the first wall portion (36*b*) and the second wall portion (37*b*) decreases from an upstream side toward a downstream side thereof.

According to the second aspect of the present disclosure, the blow-out path (F) of the cross-flow fan (30) is provided with the narrowed portion (70) whose cross-sectional area decreases as the distance between the first wall portion (36*b*) and the second wall portion (37*b*) decreases from the upstream side toward the downstream side. Therefore, when the blown air that has flowed into the blow-out path (F) passes through the narrowed portion (70), the flow is gradually contracted. This can reduce the decrease in the flow rate of the blown air in the downstream side of the blow-out path (F).

A third aspect of the present disclosure is an embodiment of the first aspect. In the third aspect, a distance between the first wall portion (36*b*) and the second wall portion (37*b*) decreases in the narrowed portion (70) from the upstream side toward the downstream side.

According to the third aspect of the present disclosure, in the narrowed portion (70), the distance between the first wall portion (36*b*) and the second wall portion (37*b*) decreases from the upstream side toward the downstream side, thereby reducing the cross-sectional area of the blow-out path (F). Therefore, when the blown air that has flowed into the blow-out path (F) passes through the narrowed portion (70), the flow is gradually contracted. This can further reduce the decrease in the flow rate of the blown air in the downstream side of the blow-out path (F).

A fourth aspect of the present disclosure is an embodiment of the first or third aspect. In the fourth aspect, portions of inner wall surfaces of the two sidewalls (38) are configured as inclined surfaces (38*a*) to form the narrowed portion (70), the inclined surfaces (38*a*) being inclined further inward of the blow-out path (F) as the sidewalls (38) extend toward the second wall portion (37*b*), and the inclined surfaces (38*a*) are formed as curved surfaces recessed toward an outside of the blow-out path (F).

According to the fourth aspect of the present disclosure, portions of the inner wall surfaces of the two sidewalls (38) are configured as the inclined surfaces (38*a*) to form the narrowed portion (70), the inclined surfaces (38*a*) being inclined further inward of the blow-out path (F) as they extend toward the second wall portion (37*b*). The inclined surfaces (38*a*) are formed as curved surfaces which are recessed toward the outside of the blow-out path (F). Since the inclined surfaces (38*a*) forming the narrowed portion are formed as the curved surfaces recessed toward the outside of the blow-out path (F), the inclined surfaces (38*a*) and the other portions are smoothly continuous with each other in the blow-out path (F).

A fifth aspect of the present disclosure is an embodiment of any one of the first to fourth aspects. In the fifth aspect, the narrowed portion (70) has a length equal to or more than half a length of the blow-out path (F).

According to the fifth aspect of the present disclosure, the narrowed portion (70) is elongated in the blow-out path (F).

A sixth aspect of the present disclosure is directed to an indoor unit of an air conditioner adjusting a temperature of indoor air, the indoor unit including: the cross-flow fan (30) of any one of the first to fifth aspects; and a heat exchanger (40) provided on an upstream side of the cross-flow fan (30) in a direction of an air flow to exchange heat between a refrigerant and air flowing through the heat exchanger (40).

In the sixth aspect of the present disclosure, the air sent through the cross-flow fan (30) passes through the heat exchanger (40), and exchanges heat with a refrigerant. The air that has exchanged heat is sucked into the cross-flow fan (30) and is blown out toward the inside of the room.

Advantages of the Invention

According to the first aspect of the present disclosure, the blow-out path (F) of the cross-flow fan (30) is provided with the narrowed portion (70) whose cross-sectional area decreases as its cross-sectional shape changes from a rectangular shape to a trapezoidal shape having a portion near the second wall portion (37*b*) smaller in width than a portion near the first wall portion (36*b*). In the narrowed portion (70), the shapes of the two sidewalls (38) change, and the portion of the narrowed portion (70) near the second wall portion (37*b*), where the blown air does not flow easily, gradually decreases in width from the upstream side toward the downstream side, thereby reducing the cross-sectional area of the path. Therefore, when the blown air that has flowed into the blow-out path (F) passes through the narrowed portion (70), the flow is contracted. In particular, in the narrowed portion (70), the flow of the blown air that has entered the blow-out path (F) is gradually contracted near the second extension wall portion (37*b*). The narrowed portion (70) formed in the blow-out path (F) in this way reduces the decrease in the flow rate of the blown air at the end portions of the blow-out path (F). That is, according to the first aspect of the present disclosure, with the narrowed portion (70) formed in the blow-out path (F), a portion where the blown air cannot flow or flows at a very low flow rate no longer exists in the blow-out path (F), and the flow of the blown air can be formed even at the end portions of the blow-out path (F) near the blow-out port (32*b*). The cross-flow fan (30) configured in this way can reduce the possibility of the separation of the blown air from the second wall portion (37*b*) during the high-load operation, thereby reducing the noise, and can reduce the possibility of the backflow near the blow-out port (32*b*) of the blow-out path (F) to avoid surging.

According to the second aspect of the present disclosure, the blow-out path (F) of the cross-flow fan (30) is provided with the narrowed portion (70) whose cross-sectional area decreases as the distance between the first wall portion (36*b*) and the second wall portion (37*b*) decreases from the upstream side toward the downstream side. Therefore, when the air that has flowed into the blow-out path (F) passes through the narrowed portion (70), the flow is gradually contracted. The narrowed portion (70) formed in the blow-out path (F) in this way reduces the decrease in the flow rate of the blown air in the downstream side of the blow-out path (F). That is, according to the second aspect of the present disclosure, with the narrowed portion (70) formed in the blow-out path (F), a portion where the blown air cannot flow or flows at a very low flow rate no longer exists in the blow-out path (F), and the flow of the blown air can be formed even at the end portions of the blow-out path (F) near the blow-out port (32*b*). The cross-flow fan (30) configured in this way can reduce the possibility of the separation of the blown air from the second wall portion (37*b*) during the high-load operation, thereby reducing the noise, and can reduce the possibility of the backflow near the blow-out port (32*b*) of the blow-out path (F) to avoid surging.

Further, according to the third aspect of the present disclosure, the distance between the first wall portion (36*b*) and the second wall portion (37*b*) decreases from the upstream side toward the downstream side in the narrowed portion (70) of the blow-out path (F). This configuration makes it possible to further reduce the decrease in the flow rate of the blown air in the downstream side of the blow-out path (F), and thus, the noise and the surging caused by the backflow can further be reduced.

According to the fourth aspect of the present disclosure, portions of the inner wall surfaces of the two sidewalls (38) are configured as the inclined surfaces (38*a*) to form the narrowed portion (70), the inclined surfaces (38*a*) being inclined further inward of the blow-out path (F) as they extend toward the second wall portion (37*b*). The inclined surfaces (38*a*) are formed as curved surfaces which are recessed toward the outside of the blow-out path (F). This configuration allows the inclined surfaces (38*a*) and the other portions to be smoothly continuous with each other in the blow-out path (F). Therefore, the narrowed portion (70), if provided in the blow-out path (F), does not serve as a resistance to the flow of the blown air, and the noise and the backflow in the blow-out path can be reduced without obstructing the flow of the blown air.

According to the fifth aspect of the present disclosure, the narrowed portion (70) is elongated to have a length equal to or greater than half the length of the blow-out path (F). This can gradually reduce the width of the blow-out path (F) as it extends from the upstream side to the downstream side. Specifically, without providing a projection for narrowing the blow-out path (F) in the blow-out path (F), the cross-sectional shape of the blow-out path (F) can be gradually changed to gradually reduce the cross-sectional area of the blow-out path (F), thereby smoothly narrowing the blow-out path (F). Since this narrowed portion (70) does not serve as a resistance to the flow of the blown air, it is possible to reduce the noise and the backflow in the blow-out path (F) without obstructing the flow of the blown air.

Further, according to the sixth aspect, the cross-flow fan (30) with reduced noise and backflow can be applied to the indoor unit (10) of the air conditioner. This can provide the indoor unit (10) with less noise.

DESCRIPTION OF EMBODIMENTS

An indoor unit of an air conditioner according to an embodiment of the present invention will be described with reference to the drawings. The embodiments described below are merely exemplary ones in nature, and are not intended to limit the scope, applications, or use of the invention.

First Embodiment of the Invention

Figure 1:
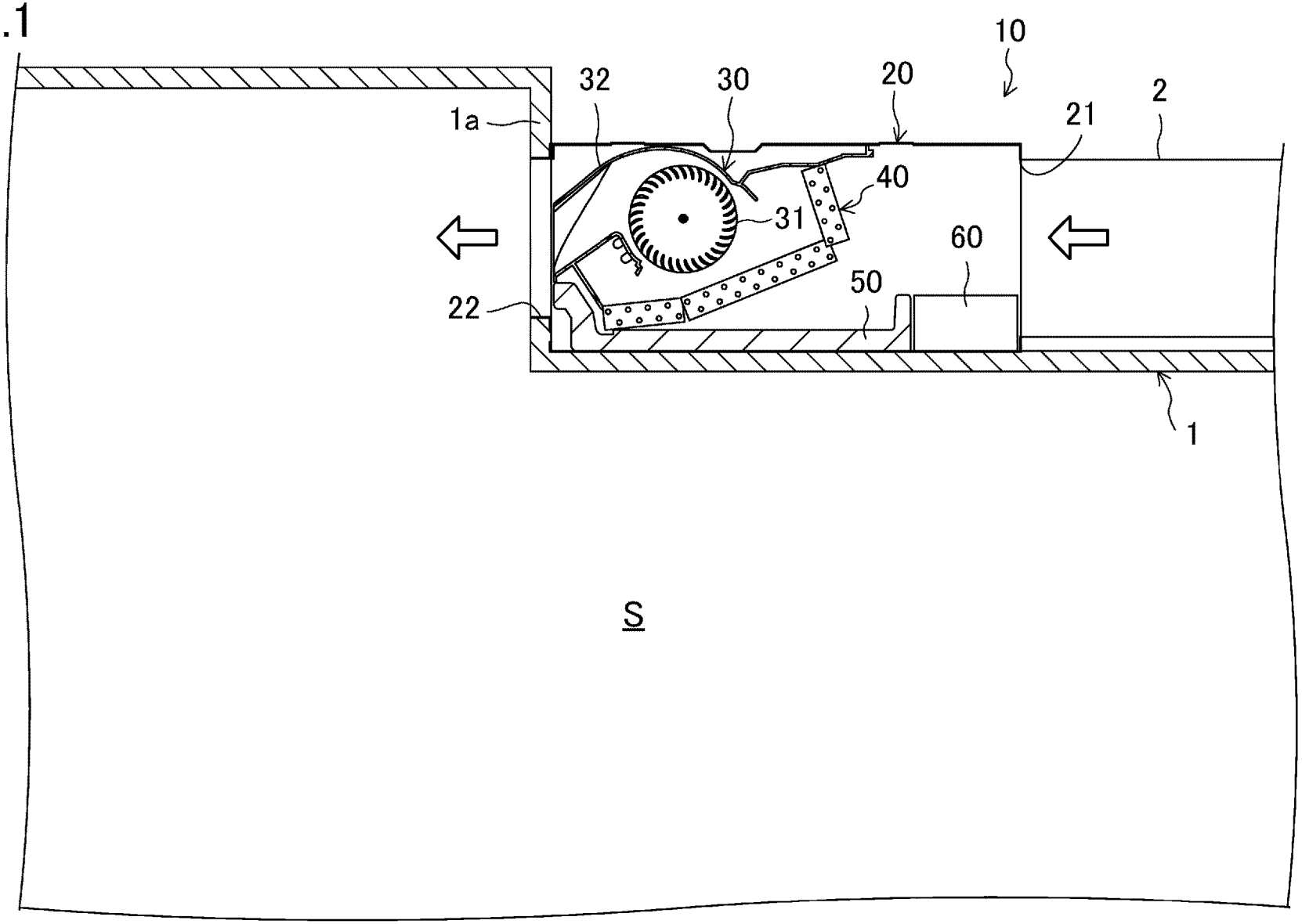
FIG. 1 is a sectional side view showing a state in which an indoor unit of an air conditioner according to a first embodiment of the present invention is installed.

As shown in FIG. 1, an indoor unit (10) is installed in a clipped ceiling (1) whose ceiling surface is lowered from a main ceiling by one step. The indoor unit (10) includes a casing (20), a cross-flow fan (30), a heat exchanger (40), a drain pan (50), and an electric component box (60). The cross-flow fan (30), the heat exchanger (40), the drain pan (50), and the electric component box (60) are installed in the casing (20).

The casing (20) is formed as a box body having a substantially rectangular parallelepiped shape. Specifically, in FIG. 1, the casing (20) is configured as a thin, longitudinally elongated box body having a greater dimension in a longitudinal direction (a direction perpendicular to the paper plane) than a dimension in a horizontal direction (a lateral direction), and a height smaller than the horizontal dimension when viewed in plan. The casing (20) has an inflow port (21) at one side thereof in the horizontal direction (right side in FIG. 1), and an outflow port (22) at the other side (left side in FIG. 1). A suction duct (2) has one end which is opened in an indoor space (S), and the other end connected to the inflow port (21). The outflow port (22) is formed like a duct, and penetrates a side surface (1*a*) of the clipped ceiling (1) to communicate with the indoor space (S).

The cross-flow fan (30) has a fan rotor (impeller) (31), a housing (32), and a motor (not shown). The cross-flow fan (30) is elongated in the longitudinal direction. Details of the cross-flow fan (30) will be described later.

The heat exchanger (40) is provided in the casing (20) on the suction side of the cross-flow fan (30). The heat exchanger (40) has three heat exchange sections, namely, first to third heat exchange sections (41 to 43). Just like the cross-flow fan (30), the first to third heat exchange sections (41 to 43) are elongated in the longitudinal direction. The first to third heat exchange sections (41 to 43) are arranged at different angles to surround the suction side of the cross-flow fan (30).

The drain pan (50) is provided below the heat exchanger (40) in the casing (20) to receive condensation water generated on the surface of the heat exchanger (40). When viewed in plan, the drain pan (50) has a longitudinal dimension and a horizontal dimension which are greater than the associated dimensions of the heat exchanger (40), and has an outer peripheral portion which is raised upward to form an outer peripheral wall blocking the received condensation water from overflowing. The drain pan (50) is mounted on a bottom plate of the casing (20). The condensation water received by the drain pan (50) is discharged to the outside via a drain hose (not shown).

The electric component box (60) is provided on an end portion of the bottom plate near the inflow port (21) in the horizontal direction in which the inflow port (21) and the outflow port (22) of the casing (20) face each other. Specifically, the electric component box (60) is disposed upstream, in the direction of the air flow formed in the casing (20), of the heat exchanger (40) on which the condensation water is generated and the drain pan (50) which receives the condensation water. The electric component box (60) is spaced apart from the outer peripheral wall of the drain pan (50), and has a smaller height than the drain pan (50).

<Cross-Flow Fan>

As described above, the cross-flow fan (30) includes the fan rotor (impeller) (31), the housing (32), and the motor (not shown).

[Fan Rotor]

Figure 2:
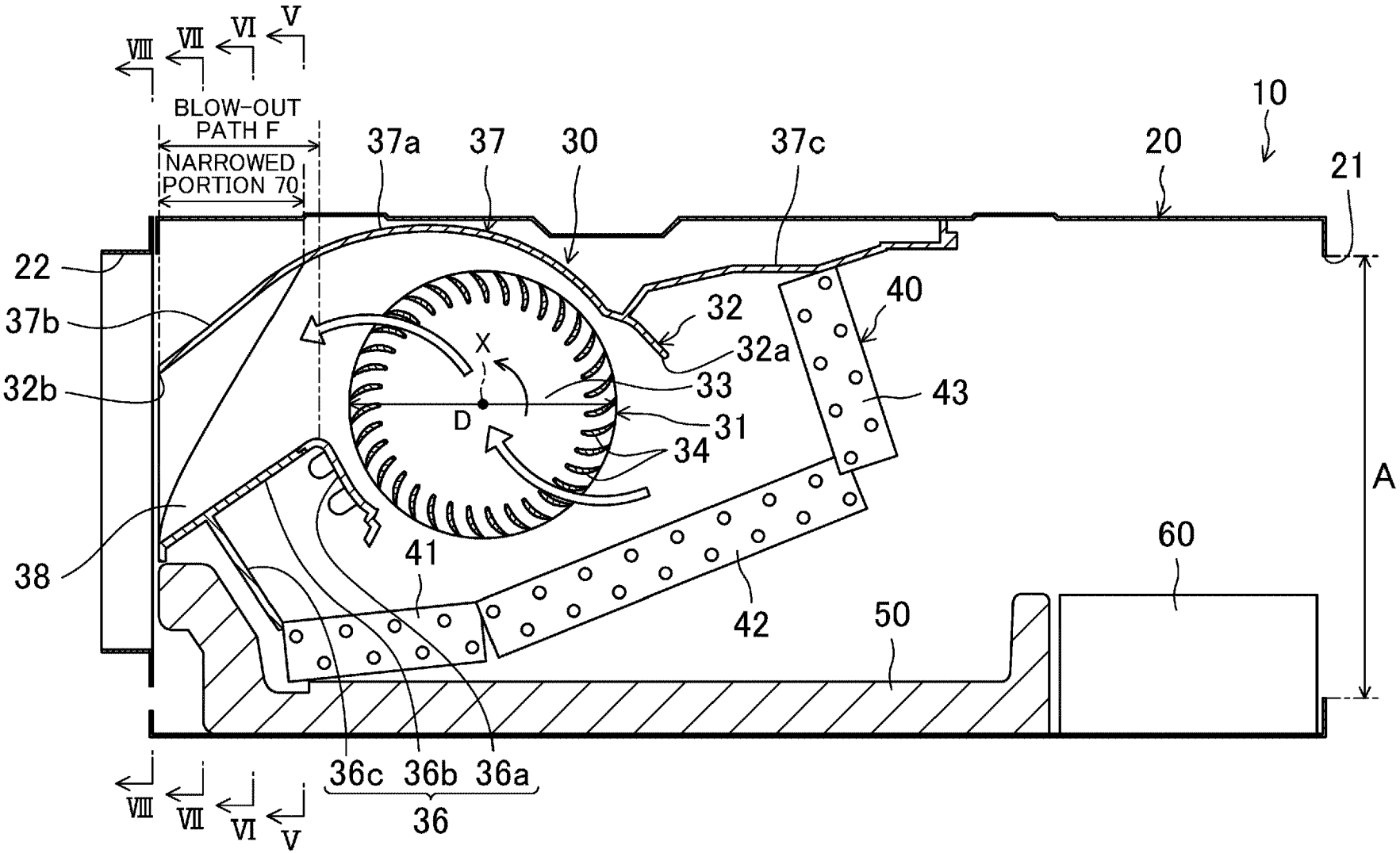
FIG. 2 is a sectional side view of the indoor unit of the air conditioner according to the first embodiment of the present invention.
Figure 3:
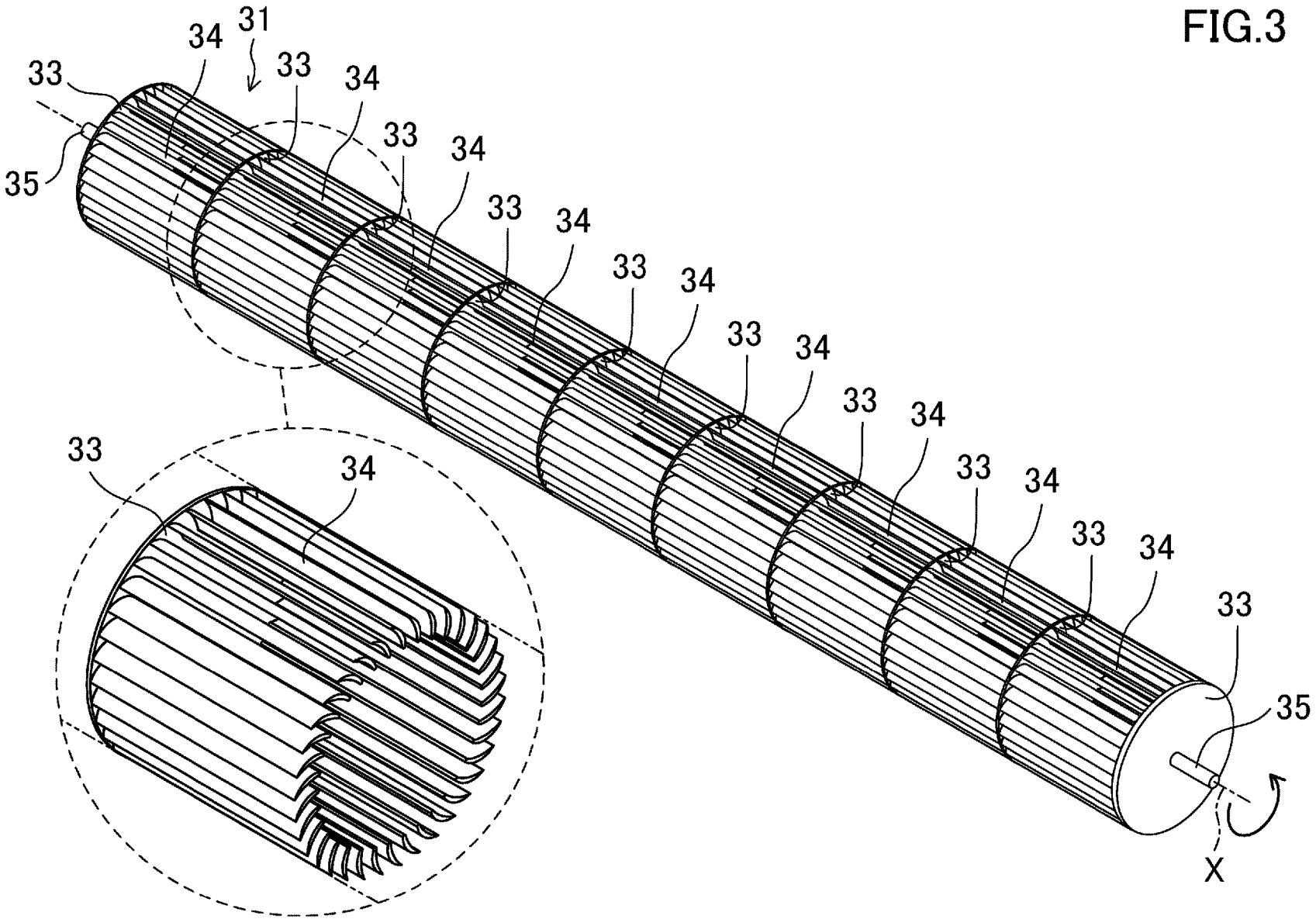
FIG. 3 is a perspective view showing, in an enlarged scale, a fan rotor of a cross-flow fan according to the first embodiment of the present invention.

As shown in FIGS. 2 and 3, the fan rotor (31) includes ten disc-shaped partition plates (33), multiple blades (34), and two shafts (35). The ten partition plates (33) are spaced apart from one another with their centers arranged on the same straight line. Note that this straight line connecting the centers serves as a center axis (rotation axis) (X) of the fan rotor (31). The two shafts (35) are formed to respectively project outward from the centers of two outermost ones of the ten partition plates (33). One of the two shafts (35) is rotatably supported by a sidewall (38) of the housing (32), which will be described later, and the other shaft (35) is connected to the motor (not shown).

The multiple blades (34) are provided on outer peripheral portions of each pair of the ten partition plates (33) facing each other to extend between the pair of the partition plates (33). The multiple blades (34) are circumferentially spaced apart from one another. Further, each of the blades (34) is curved so as to bulge in the direction opposite to the rotation direction (direction indicated by the arrow in FIG. 2) in the circumferential direction of the fan rotor (31), and is arranged to be inclined such that an inner portion thereof in the radial direction of the fan rotor (31) is shifted toward the direction opposite to the rotation direction in the circumferential direction with respect to an outer portion thereof.

In this configuration of the first embodiment, the fan rotor (31) is formed such that nine sets of a pair of partition plates (33) facing each other and a plurality of blades (34) connecting the outer peripheral portions of the pair of partition plates (33) are sequentially arranged in an axial direction.

[Housing]

Figure 4:
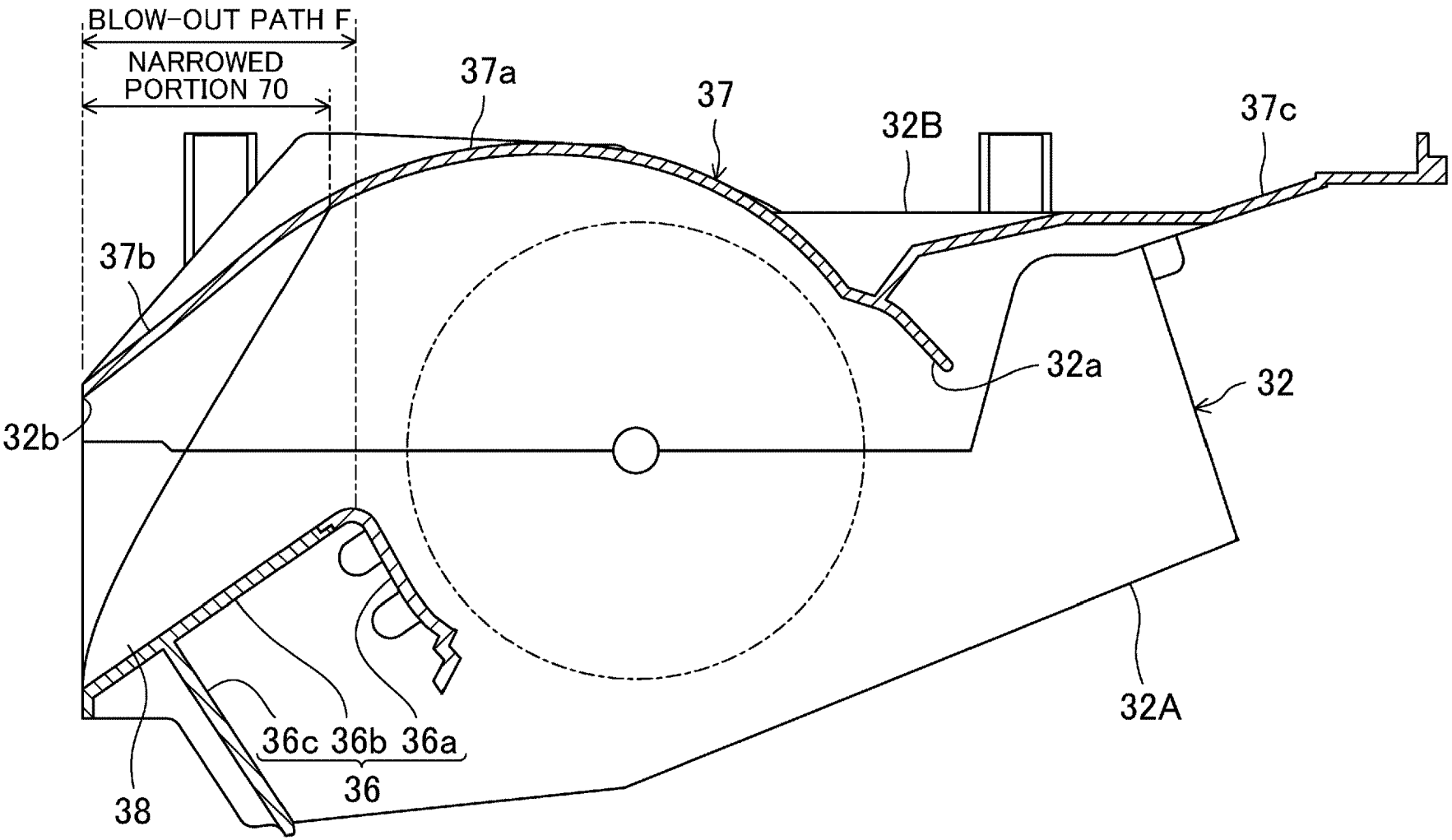
FIG. 4 is a sectional side view of a housing of the cross-flow fan according to the first embodiment of the present invention.

As shown in FIGS. 2 and 4, the housing (32) has a suction port (32*a*) for sucking the air and a blow-out port (32*b*) for blowing the air out, and is formed into a box-like shape so that the fan rotor (31) is housed therein. The housing (32) includes a first guide (36) provided below the fan rotor (31), a second guide (37) provided above the fan rotor (31), and two sidewalls (38) respectively provided at axial ends of the fan rotor (31).

The first guide (36) is located below the center axis (X) of the fan rotor (31) and closer to the blow-out port (32*b*) than the center axis (X), and elongated in the axial direction of the fan rotor (31). The first guide (36) has a tongue portion (36*a*), a first extension wall portion (first wall portion) (36*b*), and a sealing portion (36*c*).

The tongue portion (36*a*) is close to, and faces, a portion of the fan rotor (31) below the center axis (X) of the fan rotor (31) and closer to the blow-out port (32*b*) than the center axis (X), and elongated in the axial direction of the fan rotor (31). A lower end of the tongue portion (36*a*) forms the suction port (32*a*).

The first extension wall portion (36*b*) is continuous with an upper end of the tongue portion (36*a*), and is bent substantially in an L-shape from the upper end of the tongue portion (36*a*). The first extension wall portion (36*b*) extends obliquely downward from the upper end of the tongue portion (36*a*) to reach the blow-out port (32*b*). That is, a lower end of the first extension wall portion (36*b*) forms the blow-out port (32*b*).

The sealing portion (36*c*) extends substantially parallel to the tongue portion (36*a*) from a lower surface of the first extension wall portion (36*b*). A lower end of the sealing portion (36*c*) abuts on the first heat exchange section (41) to seal the gap between the suction port (32*a*) and the heat exchanger (40) so that the air that has flowed into the casing (20) is blocked from bypassing the heat exchanger (40) and being sucked into the fan (30).

The second guide (37) is elongated in the axial direction of the fan rotor (31) above the center axis (X) of the fan rotor (31), and covers a large area of an outer peripheral surface of the fan rotor (31) from above. The second guide (37) has a scroll wall portion (37*a*), a second extension wall portion (second wall portion) (37*b*), and a sealing portion (37*c*).

The scroll wall portion (37*a*) is a wall portion formed in a spiral shape except for a one end portion thereof, and elongated in the axial direction of the fan rotor (31) above the center axis (X) of the fan rotor (31) to cover the outer peripheral surface of the fan rotor (31). One end of the scroll wall portion (37*a*) on the suction side (right side in FIG. 2) defines the suction port (32*a*), and the one end portion of the scroll wall portion (37*a*) including the suction port (32*a*) is formed to approach the fan rotor (31) as it extends from the upstream side to the downstream side. The scroll wall portion (37*a*) is formed to be away from the fan rotor (31) as it extends toward the downstream side (toward the blow-out port (32*b*)) from a portion thereof closest to the fan rotor (31). The scroll wall portion (37*a*) extends to a position immediately above an upper end portion of the tongue portion (36*a*). In addition, the portion of the scroll wall portion (37*a*) closest to the fan rotor (31) is positioned across the center axis (X) of the fan rotor (31) from a portion of the tongue portion (36*a*) closest to the fan rotor (31).

The second extension wall portion (37*b*) is formed to be smoothly continuous with the scroll wall portion (37*a*) at a position directly above the upper end portion of the tongue portion (37*a*). The second extension wall portion (37*b*) extends to face the first extension wall portion (36*b*) to reach the blow-out port (32*b*). That is, a lower end of the second extension wall portion (37*b*) defines the blow-out port (32*b*).

The sealing portion (37*c*) extends obliquely upward from an upper surface of the one end portion of the scroll wall portion (37*a*) toward a top panel of the casing (20). A lower surface of the sealing portion (37*c*) abuts on the third heat exchange section (43) to seal the gap between the suction port (32*a*) and the heat exchanger (40) so that the air that has flowed into the casing (20) through the inflow port (21) is blocked from bypassing the heat exchanger (40) and being sucked into the fan (30).

The two sidewalls (38) are respectively provided at axial ends of the fan rotor (31). Each of the two sidewalls (38) has a lower end portion extending along an upper end surface of the heat exchanger (40), and an upper end portion corresponding to an upper end portion of the scroll wall portion (37*a*). Each of the two sidewalls (38) has an insertion hole through which an associated one of the shafts (35) of the fan rotor (31) is inserted. The two sidewalls (38) form an air flow path through which the air flows from the suction port (32*a*) toward the blow-out port (32*b*) between the first guide (36) and the second guide (37). In addition, the two sidewalls (38) form a blow-out path (F) for guiding the air blown from the fan rotor (31) to the blow-out port (32*b*) between the first extension wall portion (36*b*) of the first guide (36) and the second extension wall portion (37*b*) of the second guide (37). Each of the two sidewalls (38) has an inclined surface (38*a*) which is inclined inwardly to provide the blow-out path (F) with a narrowed portion (70) which will be described later.

As shown in FIG. 4, in the first embodiment, the housing (32) has two portions, namely, a lower housing (32A) and an upper housing (32B). The first guide (36) is formed in the lower housing (32A), and the second guide (37) is formed in the upper housing (32B). The two sidewalls (38) are each divided into lower and upper portions. The lower portion is formed in the lower housing (32A), and the upper portion is formed in the upper housing (32B).

[Blow-Out Path]

As described above, the blow-out path (F) is defined in the housing (32) by the first extension wall portion (36*b*) of the first guide (36) and the second extension wall portion (37*b*) of the second guide (37) facing each other and the two sidewalls (38). Further, the blow-out path (F) has the narrowed portion (70) having a cross-sectional shape changing from a rectangular shape to a trapezoidal shape, and a cross-sectional area decreasing, from the upstream side to the downstream side of the blow-out path (F). Note that the trapezoidal shape includes a shape in which sides connecting the top and the bottom are not linear but curved.

The narrowed portion (70) is formed to have a length equal to or more than half the length of the blow-out path (F) (the length of each of the first extension wall portion (36*b*) and the second extension wall portion (37*b*)). In the first embodiment, the narrowed portion (70) is formed to occupy most of the blow-out path (F) except for an upstream portion thereof.

The narrowed portion (70) is configured so that its cross-sectional shape changes as the shapes of the two sidewalls (38) change from the upstream side to the downstream side. Specifically, portions of inner wall surfaces of the two sidewalls (38) facing the inside of the blow-out path (F) are formed as inclined surfaces (38*a*) which are positioned further inward of the blow-out path (F) as they come closer to the second extension wall portion (37*b*). The inclined surfaces (38*a*) are each formed so that the ratio of the inclined surface (38*a*) to the inner wall surface of an associated one of the two sidewalls (38) increases as they extend from the upstream side to the downstream side of the blow-out path (F). Specifically, at the upstream side of the narrowed portion (70), only an upper portion of the inner wall surface of each of the two sidewalls (38) is formed as the inclined surface (38*a*), while at the downstream side of the narrowed portion (70), most portion of the inner wall surface of each of the two sidewalls (38) ranging from the upper portion to lower portion thereof is formed as the inclined surface (38). As described above, in the narrowed portion (70), the two sidewalls (38) change in the shape as they extend from the upstream side to the downstream side. Thus, the cross-sectional shape of the narrowed portion (70) changes from the rectangular shape to the trapezoidal shape from the upstream side to the downstream side of the narrowed portion (70).

Figure 5:
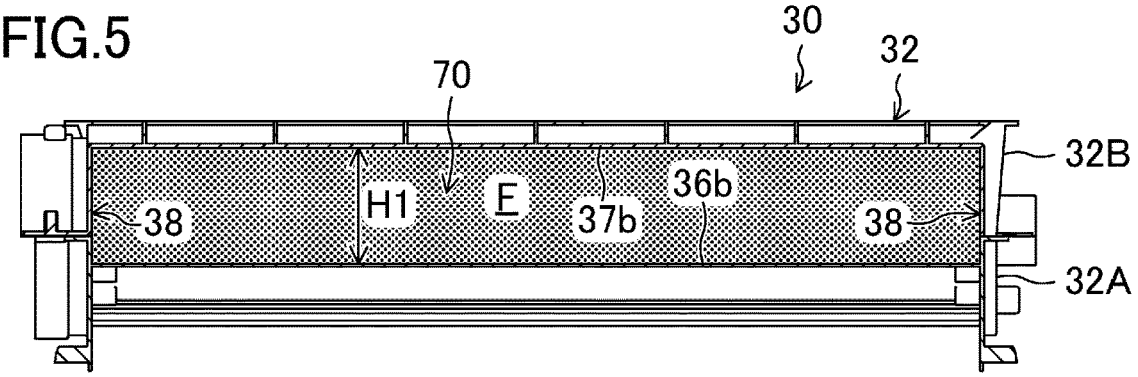
FIG. 5 is a cross-sectional view of the cross-flow fan viewed along arrows V-V shown in FIG. 2.
Figure 6:
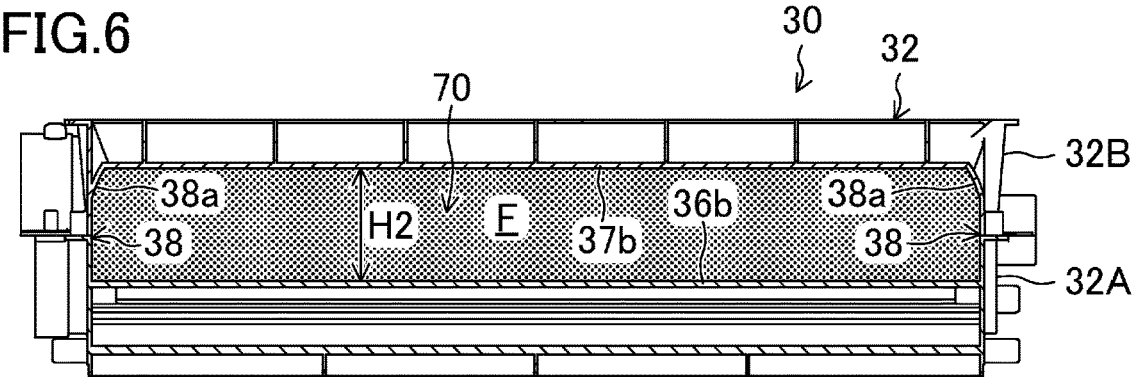
FIG. 6 is a cross-sectional view of the cross-flow fan viewed along arrows VI-VI shown in FIG. 2.
Figure 7:
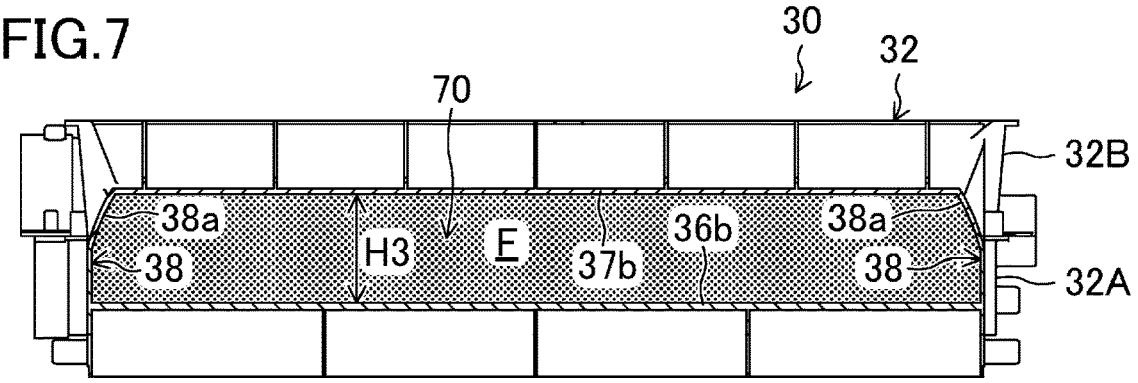
FIG. 7 is a cross-sectional view of the cross-flow fan viewed along arrows VII-VII shown in FIG. 2.
Figure 8:
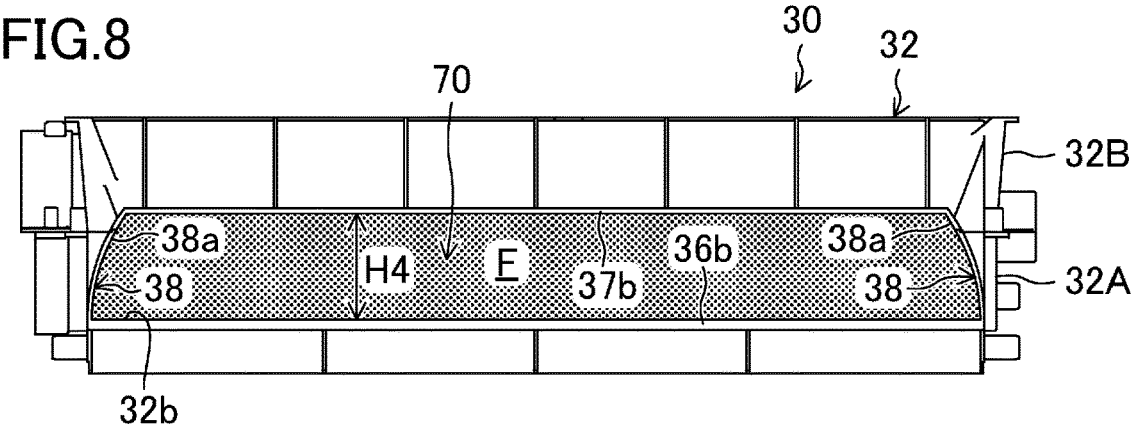
FIG. 8 is a cross-sectional view of the cross-flow fan viewed along arrows VIII-VIII shown in FIG. 2.

The change in the cross-sectional shape of the narrowed portion (70) will be described with reference to FIG. 2 and FIGS. 5 to 8. FIGS. 5 to 8 show cross sections of the blow-out path (F) taken along planes parallel to the blow-out port (32*b*). FIG. 5 shows a cross section of the starting end (most upstream end) of the narrowed portion (70) taken at a first position, FIG. 6 shows a cross section of the narrowed portion (70) taken at a second position downstream of the first position, FIG. 7 shows a cross section of the narrowed portion (70) taken at a third position downstream of the second position, and FIG. 8 shows a cross section of the terminal end (most downstream end) of the narrowed portion (70) taken at a fourth position, i.e., a cross section at the blow-out port (32*b*).

As shown in FIGS. 2 and 5, at the most upstream first position of the narrowed portion (70), each of the inner wall surfaces of the two sidewalls (38) has no inclined surface (38*a*), and extends straight in the vertical direction. Therefore, the cross-sectional shape of the blow-out path (F) at the first position is rectangular (see the dotted area in FIG. 5).

As shown in FIGS. 2 and 6, at the second position downstream of the first position of the narrowed portion (70), portions of the inner wall surfaces of the two sidewalls (38) near the second extension wall portion (37*b*) are configured as the inclined surfaces (38*a*) which are located further inward of the narrowed portion (70) as they come closer to the second extension wall portion (37*b*). Therefore, at the second position, the blow-out path (F) has a substantially hexagonal cross-sectional shape similar to a rectangular shape (see the dotted area in FIG. 6).

As shown in FIGS. 2 and 7, at the third position further downstream of the second position of the narrowed portion (70), most portions of the inner wall surfaces of the two sidewalls (38) except for portions thereof near the first extension wall portion (36*b*) are configured as the inclined surfaces (38*a*) which are located further inward of the narrowed portion (70) as they come closer to the second extension wall portion (37*b*). Therefore, at the third position, the blow-out path (F) has a substantially hexagonal cross-sectional shape similar to a trapezoidal shape (see the dotted area in FIG. 7).

As shown in FIGS. 2 and 8, at the most downstream fourth position of the narrowed portion (70), the inner wall surfaces of the two sidewalls (38) are entirely configured as the inclined surfaces (38*a*) which are located further inward of the narrowed portion (70) as they come closer to the second extension wall portion (37*b*). Therefore, at the fourth position, the blow-out path (F) has a trapezoidal cross-sectional shape (see the dotted area in FIG. 8).

As shown in FIGS. 5 to 8, in the first embodiment, the inclined surfaces (38*a*) are formed as curved surfaces which are recessed toward the outside of the blow-out path (F). This allows the inclined surfaces (38*a*) and other portions of the blow-out path (F) to be smoothly continuous with each other.

Further, as shown in FIGS. 5 to 8, at each of the first to fourth positions of the narrowed portion (70), the first extension wall portion (36*b*) and the second extension wall portion (37*b*) are parallel to each other. The first extension wall portion (36*b*) and the second extension wall portion (37*b*) in the narrowed portion (70) are formed to have a distance therebetween decreasing from the upstream side to the downstream side of the narrowed portion (70) (from the first position shown in FIG. 5 toward the fourth position shown in FIG. 8). Specifically, in the narrowed portion (70), the first extension wall portion (36*b*) and the second extension wall portion (37*b*) approach each other as they extend from the upstream side to the downstream side.

Specifically, the first extension wall portion (36*b*) and the second extension wall portion (37*b*) are formed to satisfy the expression H1>H2>H3>H4, where H1 is the distance between the first and second extension wall portions (36*b*) and (37*b*) at the first position shown in FIG. 5, H2 is the distance between the first and second extension wall portions (36*b*) and (37*b*) at the second position shown in FIG. 6, H3 is the distance between the first and second extension wall portions (36*b*) and (37*b*) at the third position shown in FIG. 7, and H4 is the distance between the first and second extension wall portions (36*b*) and (37*b*) at the fourth position shown in FIG. 8.

Assuming that the distance between the first and second extension wall portions (36*b*) and (37*b*) at the starting end (the upstream ends of the first and second extension wall portions (36*b*) and (37*b*)) of the blow-out path (F) is H0 as shown in FIG. 2, H0 is substantially equal to H1 and is greater than H4. That is, in the first embodiment, H4/H0<1 is satisfied.

In this way, the narrowed portion (70) has the cross-sectional shape changing from a rectangular shape to a trapezoidal shape from the upstream side to the downstream side, and the distance between the first and second extension wall portions (36*b*) and (37*b*) gradually decreases. Thus, the cross-sectional area of the blow-out path (F) gradually decreases. As a result, when the blown air that has flowed into the blow-out path (F) passes through the narrowed portion (70), the flow is gradually contracted, and the blown air flows to every part of the blow-out path (F) even on the downstream side.

—Operation—

In the indoor unit (10) of the air conditioner, an air flow directed from the inflow port (21) to the outflow port (22) is formed in the casing (20) when the fan (30) is activated. This causes the air in the indoor space (S) to flow into the casing (20) via the suction duct (2). The air that has flowed into the casing (20) through the inflow port (21) exchanges heat with the refrigerant when passing through the heat exchanger (40), and has its temperature adjusted (heated or cooled). The air having its temperature adjusted is sucked into the fan (30), flows through an air flow path formed in the housing (32), and is blown out of the blow-out port (32*b*). The air blown out of the fan (30) is supplied into the indoor space (S) through the outflow port (22). This air adjusts the temperature of the air in the indoor space (S).

<Air Flow in Fan>

When the fan rotor (31) rotates in the fan (30), an air flow penetrating the fan rotor (31) is formed in the housing (32) (see open arrows in FIG. 2). This air flow travels substantially in the S form due to the curved shape of the blades (34) of the fan rotor (31). The air blown out of the fan rotor (31) flows into the blow-out path (F). At this time, since the fan rotor (31) rotates toward the tongue portion (36*a*) on the blowing side, the flow of the blown air is concentrated toward the tongue portion (36*a*).

In the first embodiment, the blow-out path (F) is provided with the narrowed portion (70) whose cross-sectional shape changes from a rectangular shape to a trapezoidal shape having a portion near the second extension wall portion (37*b*) which is smaller in width than a portion near the first extension wall portion (36*b*). The inclined surfaces (38*a*) of the two sidewalls (38) allow the portion of the narrowed portion (70) near the second extension wall portion (37*b*) where the blown air does not easily flow to gradually decrease in width from the upstream side to the downstream side. Therefore, when the blown air that has flowed into the blow-out path (F) passes through the narrowed portion (70), the flow of the blown air near the second extension wall portion (37*b*) is gradually contracted.

Unlike the first embodiment, if the width of the downstream portion of the blow-out path (F) near the second extension wall portion (37*b*) is not reduced, the flow rate of the blown air significantly decreases due to the friction with the two sidewalls (38) at both end portions of the blow-out path (F). Therefore, when the pressure loss of the air flow increases due to the clogging of a filter (not shown) of the indoor unit (10) in which the fan (30) is provided, the blown air hardly flows at the end portions of the blow-out path (F) near the blow-out port (32*b*), and the air may reversely flow toward the upstream side of the blow-out path from the end portions.

Further, unlike the first embodiment, if the opening width of the inflow port (21) cannot be increased from the viewpoint of avoiding the increase in the size of the indoor unit (10), the air flow path in the indoor unit (10) is narrowed, and the pressure loss (internal pressure loss) in the interior of the indoor unit (10) becomes relatively high. Specifically, as shown in FIG. 2, in the first embodiment, A/D≤about 2.5 is satisfied, where A is the opening width of the inflow port (21) (a width obtained when the inflow port (21) is cut along the radial direction of the fan rotor (31)), and D is the diameter of the fan rotor (31). In this manner, when the opening width A cannot be kept large, the pressure loss (internal pressure loss) in the interior of the indoor unit (10) becomes high, and the volume of the air with respect to the number of rotations of the fan (30) decreases. As a result, the blown air hardly flows at the end portions of the blow-out path (F) near the blow-out port (32*b*) where the blown air does not flow easily. This increases the possibility that the air reversely flows toward the upstream side of the blow-out path (F) from the end portions near the blow-out port (32*b*).

However, in the first embodiment, since the narrowed portion (70) contracts the flow of the blown air near the second extension wall portion (37*b*), the decrease in the flow rate of the blown air near the second extension wall portion (37*b*) around the blow-out port (32*b*) of the blow-out path (F) is reduced.

Further, in the first embodiment, the narrowed portion (70) of the blow-out path (F) is configured such that the distance between the first wall portion (36*b*) and the second wall portion (37*b*) decreases from the upstream side to the downstream side of the narrowed portion (70), so that the cross-sectional area of the path is further reduced. Therefore, when the blown air that has flowed into the blow-out path (F) passes through the narrowed portion (70), the flow is further contracted, and the decrease in the flow rate of the blown air in the downstream portion of the blow-out path (F) near the second extension wall portion (37*b*) is further reduced.

In this way, in the first embodiment, the blown air flows to every part of the blow-out path (F) even on the downstream side, and is blown out of the blow-out port (32*b*). Specifically, with the narrowed portion (70) provided in the blow-out path (F), a portion where the blown air cannot flow or flows at a very low flow rate no longer exists on the downstream side of the blow-out path (F). This can avoid the blown air from being separated from the second extension wall section (37*b*) during the high-load operation, and can block the air from reversely flowing from the end portions of the blow-out port (32*b*).

Advantages of First Embodiment

As can be seen, according to the first embodiment, the blow-out path (F) of the cross-flow fan (30) is provided with the narrowed portion (70) whose cross-sectional shape changes from a rectangular shape to a trapezoidal shape having a portion near the second extension wall portion (37*b*) which is smaller in width than a portion near the first extension wall portion (36*b*). In the narrowed portion (70), the shapes of the two sidewalls (38) change, and the portion of the narrowed portion (70) near the second extension wall portion (37*b*), where the blown air does not flow easily, gradually decreases in width from the upstream side to the downstream side, thereby reducing the cross-sectional area of the path. Therefore, when the blown air that has flowed into the blow-out path (F) passes through the narrowed portion (70), the flow is contracted. In particular, in the narrowed portion (70), the flow of the blown air that has entered the blow-out path (F) is gradually contracted near the second extension wall portion (37*b*). The narrowed portion (70) formed in the blow-out path (F) in this way reduces the decrease in the flow rate of the blown air at the end portions of the blow-out path (F). Thus, according to the first embodiment, with the narrowed portion (70) formed in the blow-out path (F), a portion where the blown air cannot flow or flows at a very low flow rate no longer exists in the blow-out path (F), and the flow of the blown air can be formed even at the end portions of the blow-out path (F) near the blow-out port (32*b*). The cross-flow fan (30) configured in this way can reduce the possibility of the separation of the blown air from the second extension wall portion (37*b*) during the high-load operation to reduce the noise, and can reduce the possibility of the backflow near the blow-out port (32*b*) of the blow-out path (F) to avoid surging.

Further, according to the first embodiment, the distance between the first wall portion (36*b*) and the second wall portion (37*b*) decreases from the upstream side to the downstream side in the narrowed portion (70) of the blow-out path (F). This configuration makes it possible to further reduce the decrease in the flow rate of the blown air in the downstream side of the blow-out path (F), and thus, the noise and the surging caused by the backflow can further be reduced.

According to the first embodiment, the narrowed portion (70) is elongated to have a length equal to or greater than half the length of the blow-out path (F). This allows the blow-out path (F) to gradually decrease in width as it extends from the upstream side to the downstream side. In other words, without providing a projection for narrowing the blow-out path (F) in the blow-out path (F), the cross-sectional shape of the blow-out path (F) is gradually changed to gradually reduce the cross-sectional area of the blow-out path (F), so that the width of the blow-out path (F) can be smoothly narrowed. Since this narrowed portion (70) does not serve as a resistance to the flow of the blown air, it is possible to reduce the noise and the backflow in the blow-out path (F) without obstructing the flow of the blown air.

Further, according to the first embodiment, in order to form the narrowed portion (70), the inclined surfaces (38*a*), which are portions of the inner wall surfaces of the two sidewalls (38) inclined further inward of the blow-out path (F) as they come closer to the second extension wall portion (37*b*), are configured as curved surfaces recessed toward the outside of the blow-out path (F). This configuration allows the inclined surfaces (38*a*) and the other portions to be smoothly continuous with each other in the blow-out path (F). Therefore, the narrowed portion (70), if provided in the blow-out path (F), does not serve as a resistance to the flow of the blown air, and the noise and the backflow in the blow-out path can be reduced without obstructing the flow of the blown air.

Moreover, according to the first embodiment, the cross-flow fan (30) with reduced noise and backflow can be applied to the indoor unit (10) of the air conditioner. This can provide the indoor unit (10) with less noise.

Second Embodiment of the Invention

In a second embodiment, the ceiling-mounted indoor unit (10) of the first embodiment is configured as a wall-mounted indoor unit which is mounted on a wall.

Figure 9:
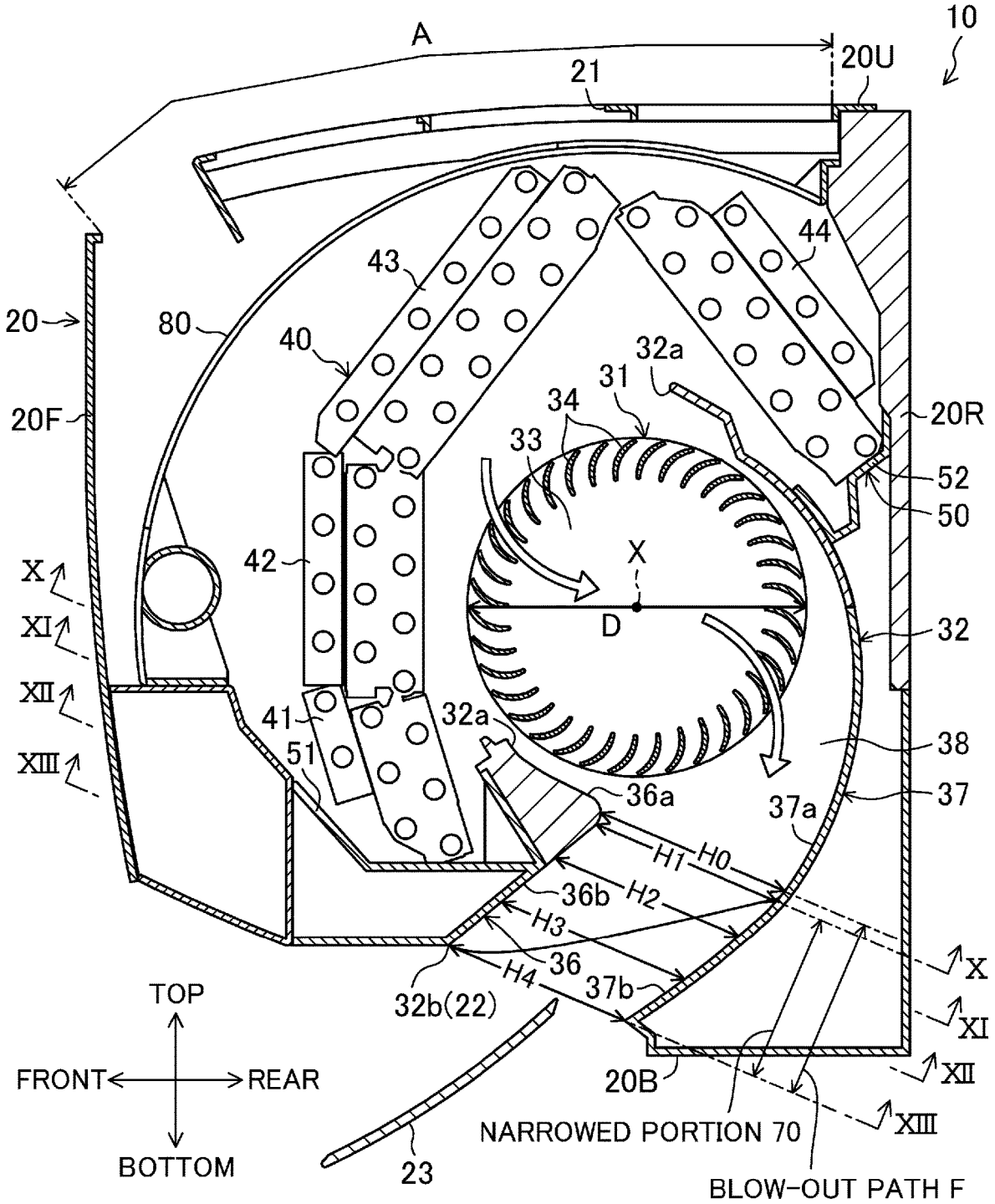
FIG. 9 is a sectional side view of an indoor unit of an air conditioner according to a second embodiment of the present invention.

Specifically, as shown in FIG. 9, the indoor unit (10) includes a casing (20), a cross-flow fan (30), a heat exchanger (40), a drain pan (50), and a filter (80). The indoor unit (10) also includes a control unit (not shown). The fan (30), the heat exchanger (40), the drain pan (50), the filter (80), and the control unit are installed in the casing (20).

The casing (20) is formed as a box body having a front panel (20F) serving as a front surface of the casing (20), a rear panel (20R) serving as a rear surface of the casing (20), a top panel (20U) serving as a top surface of the casing (20), a bottom panel (20B) serving as a bottom surface of the casing (20), and two side panels (20S) serving as side surfaces of the casing (20). Further, the casing (20) has an inflow port (21) through which the air flows therein, and an outflow port (22) through which the air flows therefrom. The inflow port (21) is formed through the top panel (20U), and the outflow port (22) is formed through the bottom panel (20B). In the second embodiment, a housing (32) of the fan (30), which will be described later, is integrated with the casing (20). Further, the outflow port (22) of the second embodiment is configured as a blow-out port (32*b*) of the fan (30) which will be described later. A flap (23) for adjusting the direction of the air to be blown into the room is provided at the blow-out port (32*b*) serving as the outflow port (22).

The fan (30) is generally configured in the same manner as that of the first embodiment. The fan (30) includes a fan rotor (impeller) (31), the housing (32), and a motor (not shown). The fan (30) is elongated in the longitudinal direction. Note that details of the fan (30) will be described later.

The heat exchanger (40) is provided in the casing (20) on the suction side of the fan (30). In the second embodiment, the heat exchanger (40) is arranged forward and upward of the fan (30). The heat exchanger (40) has four heat exchange sections, i.e., first to fourth heat exchange sections (41 to 44). The first to fourth heat exchange sections (41 to 44) are arranged at different angles to surround the suction side (front and upper sides) of the fan (30).

The drain pan (50) is provided below the heat exchanger (40) in the casing (20) to receive condensation water generated on the surface of the heat exchanger (40). In the second embodiment, the drain pan (50) includes a front drain pan (51) provided below the first heat exchange section (41) and a rear drain pan (52) provided below the fourth heat exchange section (44). In the second embodiment, the drain pan (50) forms part of the casing (20). The condensation water received by the drain pan (50) is discharged to the outside via a drain hose (not shown).

The filter (80) is provided in the casing (20) to be located upstream of the heat exchanger (40) in the direction of the air flow from the inflow port (21) to the outflow port (22), i.e., between the inflow port (21) and the heat exchanger (40). The filter (80) is formed in a shape extending along the heat exchanger (40), and covers the heat exchanger (40) from the front and upper sides thereof. The filter (80) captures dust taken into the casing (20) together with the air through the inflow port (21), and blocks the dust from flowing toward the downstream side (toward the heat exchanger (40) and the fan (30)).

<Cross-Flow Fan>

The cross-flow fan (30) includes a fan rotor (impeller) (31), a housing (32), and a motor (not shown), just like that of the first embodiment.

[Fan Rotor]

The fan rotor (31) has a configuration similar to that of the first embodiment, and includes a plurality of disc-shaped partition plates (33), many blades (34), and two shafts (35) as shown in FIGS. 3 and 9. The plurality of partition plates (33) are spaced apart from one another so that their centers are arranged on the same straight line. Note that this straight line connecting the centers serves as a center axis (rotation axis) (X) of the fan rotor (31). The two shafts (35) are formed to respectively project outward from the centers of two outermost ones of the partition plates (33). One of the two shafts (35) is rotatably supported by a sidewall (38) of the housing (32), which will be described later, and the other shaft (35) is connected to the motor (not shown).

The multiple blades (34) are provided on outer peripheral portions of each pair of the partition plates (33) facing each other to extend between the pair of the partition plates (33). The multiple blades (34) are circumferentially spaced apart from one another. Further, each of the blades (34) is curved so as to bulge in the direction opposite to the rotation direction (direction indicated by the arrow in FIG. 9) in the circumferential direction of the fan rotor (31), and is arranged to be inclined such that an inner portion thereof in the radial direction of the fan rotor (31) is shifted toward the direction opposite to the rotation direction in the circumferential direction with respect to an outer portion thereof.

In this configuration of the second embodiment, the fan rotor (31) is formed such that plural sets of a pair of partition plates (33) facing each other and a plurality of blades (34) connecting the outer peripheral portions of the pair of partition plates (33) are connected together in an axial direction.

[Housing]

As shown in FIG. 9, the housing (32) has a suction port (32*a*) for sucking the air and a blow-out port (32*b*) for blowing the air out, and is formed into a box-like shape so that the fan rotor (31) is housed therein. As described above, in the second embodiment, the housing (32) is integrated with the casing (20). The housing (32) includes a first guide (36) provided forward of the fan rotor (31), a second guide (rear guider) (37) provided rearward of the fan rotor (31), and two sidewalls (38) respectively provided at axial ends of the fan rotor (31).

The first guide (36) is located forward and downward of the center axis (X) of the fan rotor (31) and near the blow-out port (32*b*), and elongated in the axial direction of the fan rotor (31). The first guide (36) has a tongue portion (stabilizer) (36*a*) and a first extension wall portion (first wall portion) (36*b*).

The tongue portion (36*a*) is close to, and faces, a portion of the fan rotor (31) which is located forward and downward of the center axis (X) of the fan rotor (31) and near the blow-out port (32*b*), and is elongated in the axial direction of the fan rotor (31). A front end of the tongue portion (36*a*) forms a suction port (32*a*).

The first extension wall portion (36*b*) is continuous with a rear end of the tongue portion (36*a*), and is bent substantially in an L-shape from the rear end of the tongue portion (36*a*). The first extension wall portion (36*b*) extends obliquely downward from the rear end of the tongue portion (36*a*) to the blow-out port (32*b*). That is, a lower end of the first extension wall portion (36*b*) forms the blow-out port (32*b*).

The second guide (37) is elongated in the axial direction of the fan rotor (31) behind the fan rotor (31), and covers a large area of an outer peripheral surface of the fan rotor (31) from behind. The second guide (37) has a scroll wall portion (37*a*), and a second extension wall portion (second wall portion) (37*b*).

The scroll wall portion (37*a*) is a wall portion formed in a spiral shape except for a one end portion thereof, and elongated in the axial direction of the fan rotor (31) behind the center axis (X) of the fan rotor (31) to cover the outer peripheral surface of the fan rotor (31). One end of the scroll wall portion (37*a*) on the suction side (upper side in FIG. 9) defines the suction port (32*a*), and the one end portion of the scroll wall portion (37*a*) including the suction port (32*a*) is formed to approach the fan rotor (31) as it extends from the upstream side to the downstream side. The scroll wall portion (37*a*) is formed to be away from the fan rotor (31) as it extends toward the downstream side (toward the blow-out port (32*b*)) from a portion thereof closest to the fan rotor (31). The scroll wall portion (37*a*) extends to a position corresponding to a rear end portion of the tongue portion (36*a*).

The second extension wall portion (37*b*) is formed to be smoothly continuous with the scroll wall portion (36*a*) at the position corresponding to the rear end portion of the tongue portion (37*a*). The second extension wall portion (37*b*) extends to face the first extension wall portion (36*b*) to reach the blow-out port (32*b*). That is, a lower end of the second extension wall portion (37*b*) defines the blow-out port (32*b*).

The two sidewalls (38) are respectively provided at axial ends of the fan rotor (31). Each of the two sidewalls (38) has an insertion hole through which an associated one of the shafts (35) of the fan rotor (31) is inserted. The two sidewalls (38) form an air flow path through which the air flows from the suction port (32*a*) toward the blow-out port (32*b*) between the first guide (36) and the second guide (37). In addition, the two sidewalls (38) form a blow-out path (F) for guiding the air blown from the fan rotor (31) to the blow-out port (32*b*) between the first extension wall portion (36*b*) of the first guide (36) and the second extension wall portion (37*b*) of the second guide (37). Each of the two sidewalls (38) has an inclined surface (38*a*) which is inclined inwardly to provide the blow-out path (F) with a narrowed portion (70) which will be described later.

[Blow-Out Path]

As described above, the blow-out path (F) is defined in the housing (32) by the first extension wall portion (36*b*) of the first guide (36) and the second extension wall portion (37*b*) of the second guide (37) facing each other and the two sidewalls (38). Further, the blow-out path (F) has the narrowed portion (70) having a cross-sectional shape changing from a rectangular shape to a trapezoidal shape, and a cross-sectional area decreasing, from the upstream side to the downstream side of the blow-out path (F). Note that the trapezoidal shape includes a shape in which sides connecting the top and the bottom are not linear but curved.

The narrowed portion (70) is formed to have a length equal to or more than half the length of the blow-out path (F) (the length of each of the first extension wall portion (36*b*) and the second extension wall portion (37*b*)). In the second embodiment, the narrowed portion (70) is formed to occupy most of the blow-out path (F) except for an upstream portion thereof.

The narrowed portion (70) is configured so that its cross-sectional shape changes as the shapes of the two sidewalls (38) changes from the upstream side to the downstream side. Specifically, portions of inner wall surfaces of the two sidewalls (38) facing the inside of the blow-out path (F) are formed as inclined surfaces (38*a*) which are positioned further inward of the blow-out path (F) as they come closer to the second extension wall portion (37*b*). The inclined surfaces (38*a*) are each formed so that the ratio of the inclined surface (38*a*) to the inner wall surface of an associated one of the two sidewalls (38) increases as they extend from the upstream side to the downstream side of the blow-out path (F). Specifically, at the upstream side of the narrowed portion (70), only a rear portion of the inner wall surface of each of the two sidewalls (38) is formed as the inclined surface (38*a*), while at the downstream side of the narrowed portion (70), most portion of the inner wall surface of each of the two sidewalls (38) ranging from the rear portion to the front portion is formed as the inclined surface (38). As described above, in the narrowed portion (70), the two sidewalls (38) change in the shape as they extend from the upstream side to the downstream side. Thus, the cross-sectional shape of the narrowed portion (70) changes from the rectangular shape to the trapezoidal shape from the upstream side to the downstream side of the narrowed portion (70).

Figure 10:
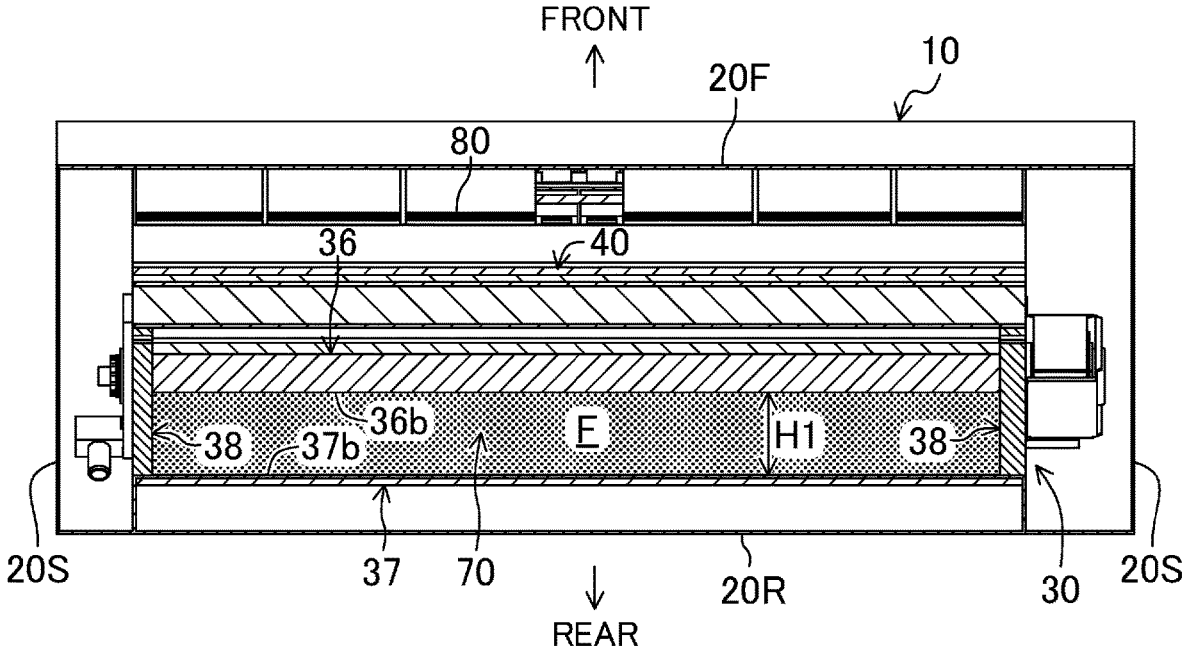
FIG. 10 is a cross-sectional view of the cross-flow fan viewed along arrows X-X shown in FIG. 9.
Figure 11:
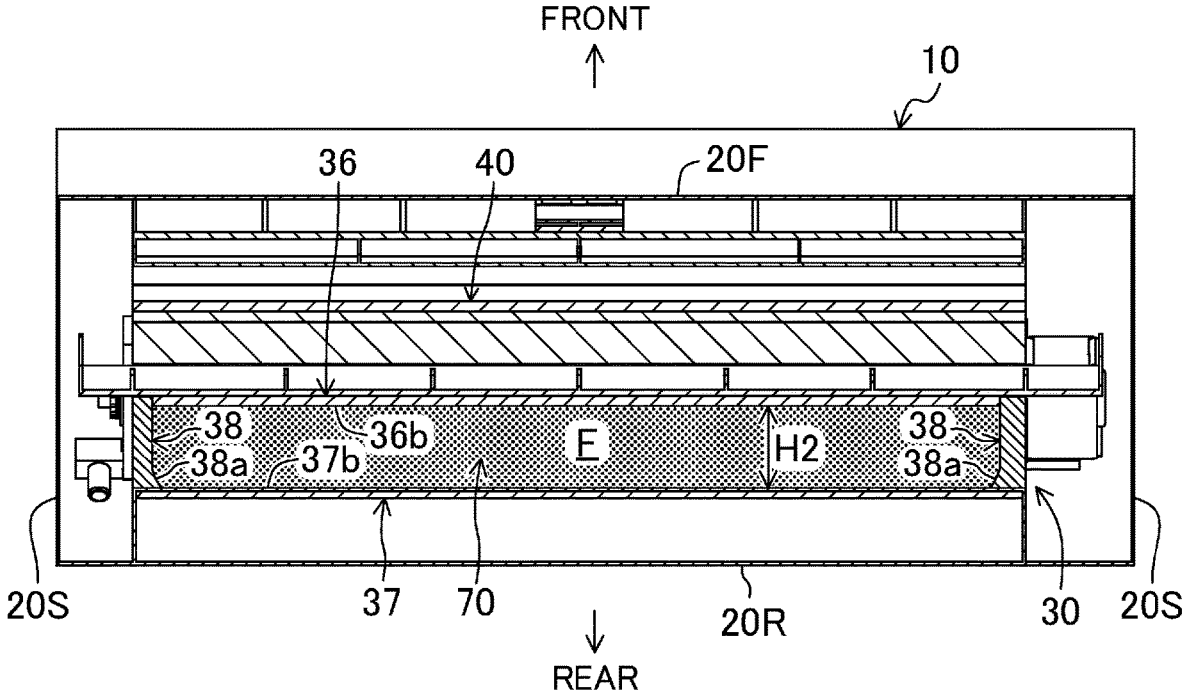
FIG. 11 is a cross-sectional view of the cross-flow fan viewed along arrows XI-XI shown in FIG. 9.
Figure 12:
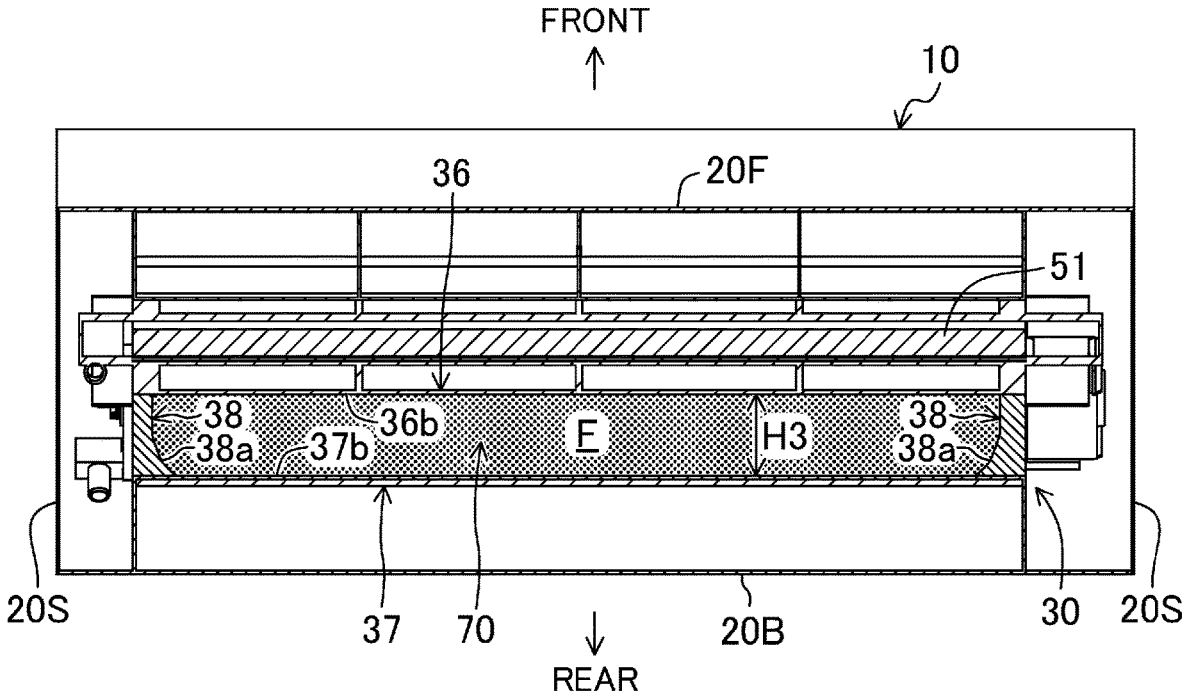
FIG. 12 is a cross-sectional view of the cross-flow fan viewed along arrows XII-XII shown in FIG. 9.
Figure 13:
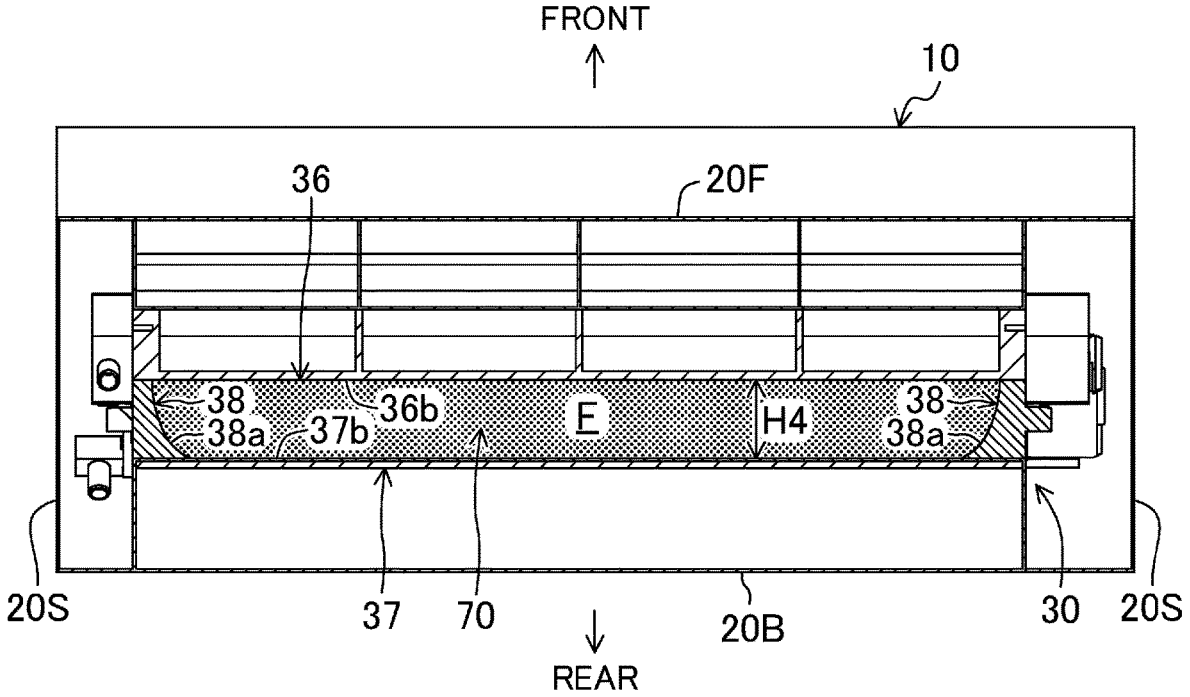
FIG. 13 is a cross-sectional view of the cross-flow fan viewed along arrows XIII-XIII shown in FIG. 9.

The change in the cross-sectional shape of the narrowed portion (70) will be described with reference to FIG. 9 and FIGS. 10 to 13. FIGS. 10 to 13 show cross sections of the blow-out path (F) taken along planes parallel to the blow-out port (32*b*). FIG. 10 shows a cross section of the starting end (most upstream end) of the narrowed portion (70) at a first position, FIG. 11 shows a cross section of the narrowed portion (70) at a second position downstream of the first position, FIG. 12 shows a cross section of the narrowed portion (70) at a third position downstream of the second position, and FIG. 13 shows a cross section of the trailing end (most downstream end) of the narrowed portion (70) at a fourth position, i.e., a cross section at the blow-out port (32*b*).

As shown in FIGS. 9 and 10, at the most upstream first position of the narrowed portion (70), each of the inner wall surfaces of the two sidewalls (38) has no inclined surface (38*a*), and extends straight. Therefore, the cross-sectional shape of the blow-out path (F) at the first position is rectangular (see the dotted area in FIG. 10).

As shown in FIGS. 9 and 11, at the second position downstream of the first position of the narrowed portion (70), portions of the inner wall surfaces of the two sidewalls (38) near the second extension wall portion (37*b*) are configured as the inclined surfaces (38*a*) which are located further inward of the narrowed portion (70) as they come closer to the second extension wall portion (37*b*). Therefore, at the second position, the blow-out path (F) has a substantially hexagonal cross-sectional shape similar to a rectangular shape (see the dotted area in FIG. 11).

As shown in FIGS. 10 and 12, at the third position further downstream of the second position of the narrowed portion (70), most portions of the inner wall surfaces of the two sidewalls (38) except for portions thereof near the first extension wall portion (36*b*) are configured as the inclined surfaces (38*a*) which are located further inward of the narrowed portion (70) as they come closer to the second extension wall portion (37*b*). Therefore, at the third position, the blow-out path (F) has a substantially hexagonal cross-sectional shape similar to a trapezoidal shape (see the dotted area in FIG. 12).

As shown in FIGS. 10 and 13, at the most downstream fourth position of the narrowed portion (70), the inner wall surfaces of the two sidewalls (38) are entirely configured as the inclined surfaces (38*a*) which are located further inward of the narrowed portion (70) as they come closer to the second extension wall portion (37*b*). Therefore, at the fourth position, the blow-out path (F) has a trapezoidal cross-sectional shape (see the dotted area in FIG. 13).

As shown in FIGS. 10 to 13, in the second embodiment, the inclined surfaces (38*a*) are formed as curved surfaces which are recessed toward the outside of the blow-out path (F). This allows the inclined surfaces (38*a*) and other portions of the blow-out path (F) to be smoothly continuous with each other.

Further, as shown in FIGS. 10 to 13, at each of the first to fourth positions of the narrowed portion (70), the first extension wall portion (36*b*) and the second extension wall portion (37*b*) are parallel to each other. The first extension wall portion (36*b*) and the second extension wall portion (37*b*) in the narrowed portion (70) are formed to have a distance therebetween decreasing from the upstream side to the downstream side of the narrowed portion (70) (from the first position shown in FIG. 10 toward the fourth position shown in FIG. 13). Specifically, in the narrowed portion (70), the first extension wall portion (36*b*) and the second extension wall portion (37*b*) approach each other as they extend from the upstream side to the downstream side.

Specifically, the first extension wall portion (36*b*) and the second extension wall portion (37*b*) are formed to satisfy the expression $H1>H2>H3>H4$, where H1 is the distance between the first and second extension wall portions (36*b*) and (37*b*) at the first position shown in FIG. 10, H2 is the distance between the first and second extension wall portions (36*b*) and (37*b*) at the second position shown in FIG. 11, H3 is the distance between the first and second extension wall portions (36*b*) and (37*b*) at the third position shown in FIG. 12, and H4 is the distance between the first and second extension wall portions (36*b*) and (37*b*) at the fourth position shown in FIG. 13.

Assuming that the distance between the first and second extension wall portions (36*b*) and (37*b*) at the starting end (the upstream ends of the first and second extension wall portions (36*b*) and (37*b*)) of the blow-out path (F) is H0 as shown in FIG. 9, H0 is substantially equal to H1 and is greater than H4. That is, in the first embodiment, $H4/H0<1$ is satisfied.

In this way, the narrowed portion (70) has the cross-sectional shape changing from a rectangular shape to a trapezoidal shape from the upstream side to the downstream side, and the distance between the first and second extension wall portions (36*b*) and (37*b*) gradually decreases. Thus, the cross-sectional area of the blow-out path (F) gradually decreases. As a result, when the blown air that has flowed into the blow-out path (F) passes through the narrowed portion (70), the flow is gradually contracted, and the blown air flows to every part of the blow-out path (F) even on the downstream side.

—Operation—

In the indoor unit (10) of the air conditioner, an air flow directed from the inflow port (21) to the outflow port (22)

(blow-out port (32*b*)) is formed in the casing (20) when the fan (30) is activated. This causes the air in the indoor space to flow into the casing (20). The air that has flowed into the casing (20) through the inflow port (21) exchanges heat with the refrigerant when passing through the heat exchanger (40), and has its temperature adjusted (heated or cooled). The air having its temperature adjusted is sucked into the fan (30), flows through an air flow path formed in the housing (32), and is supplied into the indoor space through the blow-out port (32*b*) of the fan (30) constituting the outflow port (22). This air adjusts the temperature of the air in the indoor space.

<Air Flow in Fan>

When the fan rotor (31) rotates in the fan (30), an air flow penetrating the fan rotor (31) is formed in the housing (32) (see open arrows in FIG. 9). This air flow travels substantially in the S form due to the curved shape of the blades (34) of the fan rotor (31). The air blown out of the fan rotor (31) flows into the blow-out path (F). At this time, since the fan rotor (31) rotates toward the tongue portion (36*a*) on the blowing side, the flow of the blown air is concentrated toward the tongue portion (36*a*).

In the second embodiment, the blow-out path (F) is provided with the narrowed portion (70) whose cross-sectional shape changes from a rectangular shape to a trapezoidal shape having a portion near the second extension wall portion (37*b*) which is smaller in width than a portion near the first extension wall portion (36*b*). The inclined surfaces (38*a*) of the two sidewalls (38) allow the portion of the narrowed portion (70) near the second extension wall portion (37*b*) where the blown air does not easily flow to gradually decrease in width from the upstream side to the downstream side. Therefore, when the blown air that has flowed into the blow-out path (F) passes through the narrowed portion (70), the flow of the blown air near the second extension wall portion (37*b*) is gradually contracted.

Unlike the second embodiment, if the width of the downstream portion of the blow-out path (F) near the second extension wall portion (37*b*) is not reduced, the flow rate of the blown air significantly decreases due to the friction with the two sidewalls (38) at both end portions of the blow-out path (F). Therefore, when the pressure loss of the air flow increases due to the clogging of a filter (80) of the indoor unit (10) in which the fan (30) is provided, the blown air hardly flows at the end portions of the blow-out path (F) near the blow-out port (32*b*), and the air may reversely flow toward the upstream side of the blow-out path from the end portions.

Also in the second embodiment, the opening width of the inflow port (21) cannot be increased from the viewpoint of avoiding the increase in the size of the indoor unit (10), and A/D≤about 2.5 is satisfied, where A is the opening width of the inflow port (21) (a width obtained when the inflow port (21) is cut along the radial direction of the fan rotor (31)), and D is the diameter of the fan rotor (31). Therefore, also in the second embodiment, the opening width A cannot be kept large, and the pressure loss (internal pressure loss) in the interior of the indoor unit (10) becomes high. This increases the possibility that the air reversely flows toward the upstream side of the blow-out path (F) from the end portions near the blow-out port (32*b*) where the blown air does not flow easily.

However, also in the second embodiment, since the narrowed portion (70) is configured to contract the flow of the blown air near the second extension wall portion (37*b*), the decrease in the flow rate of the blown air near the second extension wall portion (37*b*) around the blow-out port (32*b*) of the blow-out path (F) is reduced.

Further, also in the second embodiment, the narrowed portion (70) of the blow-out path (F) is configured such that the distance between the first wall portion (36*b*) and the second wall portion (37*b*) decreases from the upstream side toward the downstream side of the narrowed portion (70), so that the cross-sectional area of the path is reduced. Therefore, when the blown air that has flowed into the blow-out path (F) passes through the narrowed portion (70), the flow is further contracted, and the decrease in the flow rate of the blown air in the downstream portion of the blow-out path (F) near the second extension wall portion (37*b*) is further reduced.

In this way, in the second embodiment, the blown air flows to every part of the blow-out path (F) even on the downstream side, and is blown out of the blow-out port (32*b*). Specifically, with the narrowed portion (70) provided in the blow-out path (F), a portion where the blown air cannot flow or flows at a very low flow rate no longer exists on the downstream side of the blow-out path (F). This can avoid the blown air from being separated from the second extension wall section (37*b*) during the high-load operation, and can block the air from reversely flowing from the end portions of the blow-out port (32*b*).

As can be seen, the cross-flow fan (30) according to the second embodiment can provide the same advantages as those of the cross-flow fan (30) according to the first embodiment. Further, also in the second embodiment, the cross-flow fan (30) with reduced noise and backflow can be applied to in the indoor unit (10) of the air conditioner. This can provide the indoor unit (10) with less noise.

Third Embodiment of the Invention

A third embodiment is a modified version of the first embodiment, in which the shape of the blow-out path (F) is changed. Except for the shape of the blow-out path (F), the third embodiment is configured in the same manner as the first embodiment. Only the configuration of the blow-out path (F) different from that of the first embodiment and how the air flows in the blow-out path (F) will be described later, and the description of the other configurations and operations will be omitted.

[Blow-Out Path]

Figure 14:
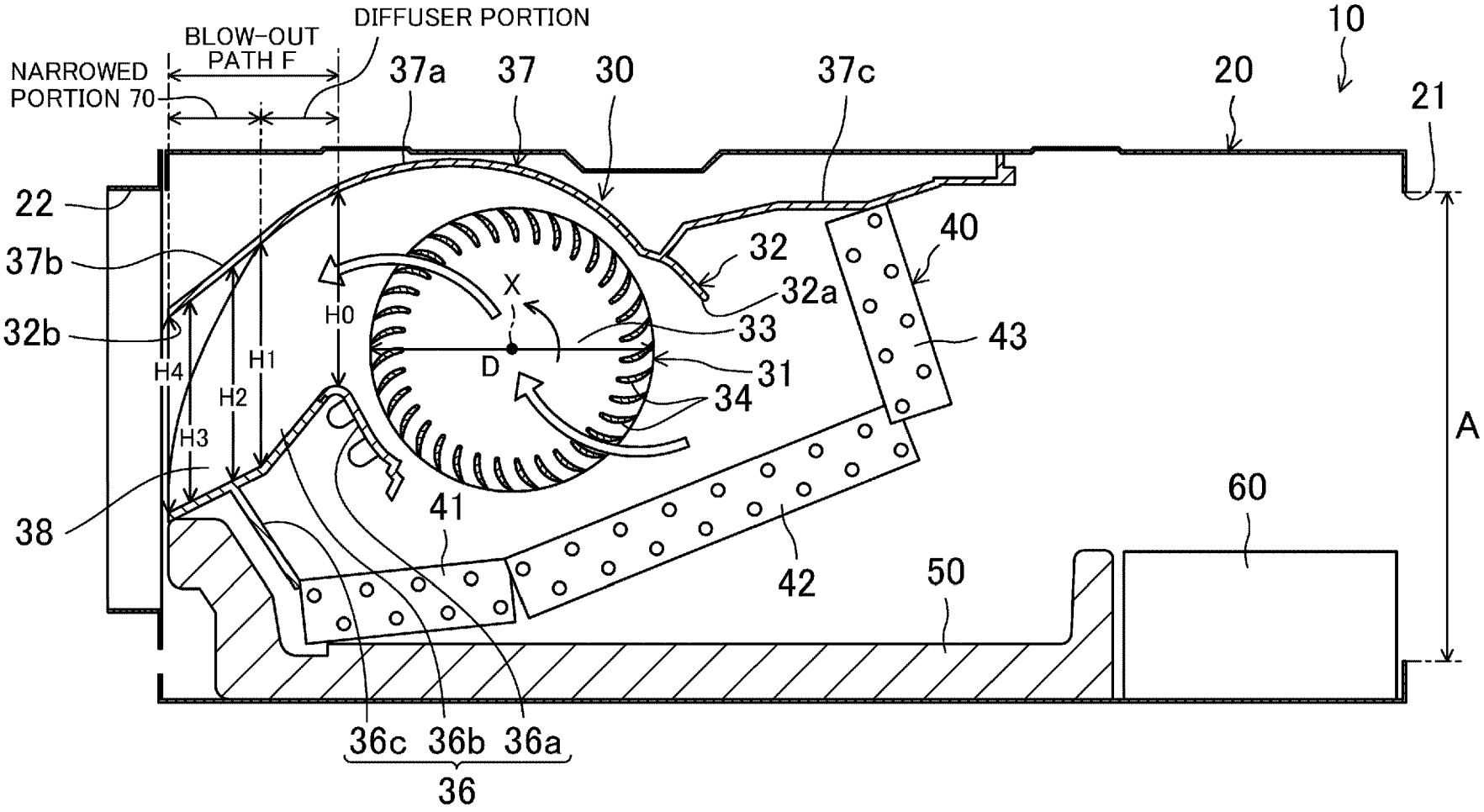
FIG. 14 is a sectional side view of an indoor unit of an air conditioner according to a third embodiment of the present invention.

As shown in FIG. 14, also in the third embodiment, the blow-out path (F) is defined by a first extension wall portion (first wall portion) (36*b*) of a first guide (36) and a second extension wall portion (second wall portion) (37*b*) of a second guide (37) facing each other and two sidewalls (38). Further, the blow-out path (F) has the narrowed portion (70) having a cross-sectional shape changing from a rectangular shape to a trapezoidal shape, and a cross-sectional area decreasing, from the upstream side to the downstream side of the blow-out path (F). Note that the trapezoidal shape includes a shape in which sides connecting the top and the bottom are not linear but curved.

In the third embodiment, the narrowed portion (70) is formed to have a length that is substantially half the length of the blow-out path (F) (the length of each of the first extension wall portion (36*b*) and the second extension wall portion (37*b*)). Specifically, in the third embodiment, a downstream half of the blow-out path (F) is configured as the narrowed portion (70). An upstream half of the blow-out path (F) is formed into a diffuser portion (71) whose cross-sectional area increases from the upstream side to the downstream side of the blow-out path (F).

The diffuser portion (71) is formed such that the distance between the first extension wall portion (36*b*) and the second extension wall portion (37*b*) increases from the upstream side to the downstream side of the diffuser portion (71) (toward the narrowed portion (70)). Specifically, in the narrowed portion (70), the first extension wall portion (36*b*) and the second extension wall portion (37*b*) are separated away from each other as from the upstream side to the downstream side of the narrowed portion (70).

The narrowed portion (70) has the same configuration as that of the first embodiment except for the length. The narrowed portion (70) is configured such that its cross-sectional shape changes from a rectangular shape to a trapezoidal shape as the shapes of the two sidewalls (38) changes from the upstream side to the downstream side. Further, as shown in FIG. 14, the narrowed portion (70) are formed such that the first extension wall portion (36*b*) and the second extension wall portion (37*b*) have a distance therebetween decreasing as they extend from the upstream side to the downstream side. Specifically, in the narrowed portion (70), the first extension wall portion (36*b*) and the second extension wall portion (37*b*) approach each other as they extend from the upstream side to the downstream side. Specifically, the narrowed portion (70) is formed to satisfy H1>H2>H3>H4, where H1, H2, H3, and H4 are respectively the distances between the first and second extension wall portions (37*b*) and (36*b*) at first, second, third, and fourth positions of the narrowed portion (70) shown in FIG. 14.

As can be seen in the third embodiment, the blow-out path (F) includes the diffuser portion (71) and the narrowed portion (70).

Assuming that the distance between the first and second extension wall portions (36*b*) and (37*b*) at the starting end (the upstream ends of the first and second extension wall portions (36*b*) and (37*b*)) of the blow-out path (F) is H0 as shown in FIG. 14, H0 is smaller than H1 and is smaller than H4. That is, in the third embodiment, H4/H0>1 is satisfied. It has been found that when the blow-out path (F) is formed to satisfy 0.9≤H4/H0≤1.03, the blowing noise which is made in a high-load operation can be reduced to a low level.

As described above, in the third embodiment, the upstream half of the blow-out path (F) is configured as the diffuser portion (71) whose cross-sectional area increases toward the downstream side. In the diffuser portion (71), the dynamic pressure of the air blown from the fan (30) is converted into a static pressure, which increases the static pressure of the fan (30). Further, in the blow-out path (F), the narrowed portion (70) whose cross-sectional area decreases toward the downstream side is provided downstream of the diffuser portion (71). In the narrowed portion (70), the cross-sectional shape changing from a rectangular shape into a trapezoidal shape, and the distance between the first extension wall portion (36*b*) and the second extension wall portion (37*b*) gradually decreases, as it extends from the upstream side to the downstream side of the blow-out path (F), so that the cross-sectional area of the blow-out path (F) gradually decreases. As a result, when the blown air that has flowed into the blow-out path (F) passes through the narrowed portion (70), the flow is gradually contracted, and the blown air flows to every part of the blow-out path (F) even on the downstream side.

[Air Flow in Blow-Out Path]

Also in the third embodiment, when the fan rotor (31) rotates in the fan (30), a substantially S-shaped air flow passing through the fan rotor (31) is formed in the housing (32) (see open arrows in FIG. 9). The air blown out of the fan rotor (31) flows into the blow-out path (F). Since the fan rotor (31) rotates toward the tongue portion (36*a*) on the blowing side, the flow of the blown air is concentrated toward the tongue portion (36*a*).

In the third embodiment, the upstream portion of the blow-out path (F) is configured as the diffuser portion (71). Therefore, the dynamic pressure of the blown air that has flowed into the blow-out path (F) is first converted into a static pressure in the diffuser portion (71). This increases the static pressure of the fan (30). Then, the blown air that has passed through the diffuser portion (71) flows into the narrowed portion (70). In the narrowed portion (70), the inclined surfaces (38*a*) of the two sidewalls (38) allow the portion of the narrowed portion (70) near the second extension wall portion (37*b*), where the blown air does not easily flow, to gradually decrease in width as it extends from the upstream side to the downstream side. In addition, in the narrowed portion (70), the first wall portion (36*b*) and the second wall portion (37*b*) have a distance therebetween decreasing as they extend from the upstream side to the downstream side. Therefore, the cross-sectional area of the narrowed portion (70) decreases toward the downstream side, and the blown air is contracted.

In this manner, in the third embodiment, the diffuser portion (71), which is the upstream portion of the blow-out path (F), converts the dynamic pressure of the blown air into the static pressure, which increases the static pressure of the fan (30), and increases the volume of the air. Further, the narrowed portion (70), which is the downstream portion of the blow-out path (F), reduces the decrease in the flow rate of the blown air in a portion of the blow-out path (F) near the second extension wall portion (37*b*). Thus, the blown air flows to every part of the blow-out path (F), and is blown out of the blow-out port (32*b*). Specifically, with the narrowed portion (70) provided in the blow-out path (F), a portion where the blown air cannot flow or flows at a very low flow rate no longer exists on the downstream side of the blow-out path (F). This can avoid the blown air from being separated from the second extension wall section (37*b*) during the high-load operation, and can block the air from reversely flowing from the end portions of the blow-out port (32*b*).

As can be seen, the cross-flow fan (30) according to the third embodiment can provide the same advantages as those of the cross-flow fan (30) according to the first embodiment. Further, also in the third embodiment, the cross-flow fan (30) with reduced noise and backflow can be applied to in the indoor unit (10) of the air conditioner. This can provide the indoor unit (10) with less noise. According to the third embodiment, the upstream portion of the blow-out path (F) is configured as the diffuser portion (71), which makes it possible to reduce the noise, and the surging due to the backflow, while increasing the air volume.

Other Embodiments

In the first and third embodiments described above, it has been described as an example that the cross-flow fan (30) of the present invention is applied to the indoor unit (10) installed in a ceiling. Further, in the second embodiment, it has been described as an example that the cross-flow fan (30) of the present invention is applied to the wall-mounted indoor unit (10) mounted on the wall. However, the configuration of the indoor unit (10) to which the cross-flow fan (30) of the present invention is applied is not limited to the above-described ones. The present invention may be applied to a floor-mounted indoor unit (10) which is mounted on the floor of an indoor space.

In the first embodiment, the indoor unit (10) has been configured to include the casing (20) provided with the inflow port (21) and the outflow port (22) formed through two side surfaces facing each other. However, the positions of the inflow port (21) and the outflow port (22) of the casing (20) are not limited to those described above. For example, the inflow port (21) may be formed through a bottom surface of the casing (20), and the outflow port (22) may be formed through one of the side surfaces of the casing (20).

In each of the above embodiments, the narrowed portion (70) has been configured to have the cross-sectional shape changing from a rectangular shape to a trapezoidal shape, and the distance between the first and second extension wall portions (36*b*) and (37*b*) decreasing, from the upstream side to the downstream side, so that the cross-sectional area of the path decreases from the upstream side to the downstream side. However, the narrowed portion (70) may be configured in any way as long as its cross-sectional area decreases from the upstream side to the downstream side. Hence, the narrowed portion (70) may be configured to have its cross-sectional area reduced only through changing its cross-sectional shape from a rectangular shape to a trapezoidal shape from the upstream side to the downstream side, without changing the distance between the first and second extension wall portions (36*b*) and (37*b*). Conversely, the narrowed portion (70) may be configured to have its cross-sectional area reduced only through changing the distance between the first and second extension wall portions (36*b*) and (37*b*) without changing its cross-sectional shape from a rectangular shape to a trapezoidal shape from the upstream side to the downstream side.

In the third embodiment, it has been described as an example that the shape of the blow-out path (F) of the first embodiment is changed. However, the blow-out path (F) of the third embodiment can be applied to the fan (30) of the wall-mounted indoor unit (10) as described in the second embodiment, and the fan (30) of the floor-mounted indoor unit (10).

INDUSTRIAL APPLICABILITY

As can be seen, the present invention is useful for a cross-flow fan including a cross-flow fan rotor, and an indoor unit of an air conditioner including the same.

DESCRIPTION OF REFERENCE CHARACTERS

10 Indoor Unit
20 Casing
21 Inflow Port
22 Outflow Port
30 Cross-Flow Fan
31 Fan Rotor
32 Housing
32*a* Suction Port
32*b* Blow-Out Port
34 Blade
36 Tongue Portion
36*b* First Extension Wall Portion (First Wall Portion)
37*b* Second Extension Wall Portion (Second Wall Portion)
38 Sidewall
38*a* Inclined Surface
40 Heat Exchanger
70 Narrowed Portion

The invention claimed is:

1. A cross-flow fan comprising:

a fan rotor including a plurality of blades and rotating about a center axis; and a housing having a suction port for sucking air and a blow-out port for blowing the air out, and housing the fan rotor therein, wherein the housing has a tongue portion, a first wall portion, a second wall portion, and two sidewalls, the tongue portion being close to an outer periphery of the fan rotor and extending in an axial direction of the fan rotor, the first wall portion continuously extending from the tongue portion to the blow-out port, the second wall portion facing the first wall portion, the two sidewalls being respectively provided at axial ends of the fan rotor to define a blow-out path between the first wall portion and the second wall portion, and the two sidewalls are formed such that the blow-out path has a narrowed portion whose cross-sectional area decreases as its cross-sectional shape changes from a rectangular shape to a trapezoidal shape from an upstream side toward a downstream side thereof, the trapezoidal shape having a portion near the second wall portion smaller in width than a portion near the first wall portion.

2. The cross-flow fan of claim 1, wherein a distance between the first wall portion and the second wall portion decreases in the narrowed portion from the upstream side toward the downstream side.

3. The cross-flow fan of claim 2, wherein the narrowed portion has a length equal to or more than half a length of the blow-out path.

4. The cross-flow fan of claim 1, wherein portions of inner wall surfaces of the two sidewalls are configured as inclined surfaces to form the narrowed portion, the inclined surfaces being inclined further inward of the blow-out path as the sidewalls extend toward the second wall portion, and the inclined surfaces are formed as curved surfaces recessed toward an outside of the blow-out path.

5. The cross-flow fan of claim 4, wherein the narrowed portion has a length equal to or more than half a length of the blow-out path.

6. The cross-flow fan of claim 1, wherein the narrowed portion has a length equal to or more than half a length of the blow-out path.

7. An indoor unit of an air conditioner adjusting a temperature of indoor air, the indoor unit comprising:

the cross-flow fan of claim 1; and a heat exchanger provided on an upstream side of the cross-flow fan in a direction of an air flow to exchange heat between a refrigerant and air flowing through the heat exchanger.

* * * * *